United States Patent [19]

Yano et al.

[11] Patent Number: 4,954,845

[45] Date of Patent: Sep. 4, 1990

[54] IMAGE FIXING DEVICE AND IMAGE FORMING APPARATUS WITH SAME

[75] Inventors: Kanji Yano; Yasutsugu Saijo; Kensaku Kusaka, all of Kawasaki; Hiromitsu Hirabayashi, Yokohama, all of Japan

[73] Assignee: Canon Kabushiki Kaisha, Tokyo, Japan

[21] Appl. No.: 387,970

[22] Filed: Aug. 1, 1989

[30] Foreign Application Priority Data

| | | | |
|---|---|---|---|
| Aug. 2, 1988 | [JP] | Japan | 63-193263 |
| Sep. 16, 1988 | [JP] | Japan | 63-231629 |
| Sep. 16, 1988 | [JP] | Japan | 63-231631 |
| Sep. 26, 1988 | [JP] | Japan | 63-240398 |
| Oct. 13, 1988 | [JP] | Japan | 63-259193 |
| Dec. 19, 1988 | [JP] | Japan | 63-320009 |

[51] Int. Cl.[5] ..... G03G 15/20; G03G 15/08; G03G 15/21

[52] U.S. Cl. ..... 355/290; 355/284; 430/124

[58] Field of Search ..... 355/290, 284, 283, 295; 430/98, 99, 100, 124; 219/216

[56] References Cited

U.S. PATENT DOCUMENTS

| | | | |
|---|---|---|---|
| 3,788,930 | 1/1974 | Honjo et al. | 430/124 X |
| 4,095,886 | 6/1978 | Koeleman et al. | 355/290 |
| 4,218,499 | 8/1980 | Shinohara et al. | 430/124 X |
| 4,393,804 | 7/1983 | Nygard et al. | 355/284 X |
| 4,514,078 | 4/1985 | Bedchaud et al. | 355/295 X |
| 4,557,588 | 12/1985 | Tomosada | 355/284 X |
| 4,711,594 | 12/1987 | Roodbeen | 355/290 |
| 4,745,432 | 5/1988 | Langdon | 355/290 |
| 4,780,742 | 10/1988 | Takahashi et al. | 355/290 |

*Primary Examiner*—A. C. Prescott

*Attorney, Agent, or Firm*—Fitzpatrick, Cella, Harper & Scinto

[57] ABSTRACT

An image fixing apparatus includes a heating device, a non-endless film movable together with a toner image supporting medium, wherein the toner image on the supporting medium is heated by the heating device through the film, a rewinding device for rewinding the film in a direction opposite to a movement direction of the toner image supporting medium, and a pressing device for press-contacting the film to the heating device and to the image supporting medium, wherein the rewinding device rewinds the film while the pressing device does not perform its pressing operation.

42 Claims, 22 Drawing Sheets

IMAGE FIXING DEVICE AND IMAGE FORMING APPARATUS WITH SAME

FIELD OF THE INVENTION AND RELATED ART

The present invention relates to an image forming apparatus such as an electrophotographic copying machine, a light printer or an electrostatic recording apparatus and an image fixing device usable with such an image forming apparatus.

A type of image fixing device for an image forming apparatus is widely used, wherein an image carrying member having an unfixed toner image is passed through a nip formed between a heating roller maintained at a predetermined temperature and a pressing or back-up roller having an elastic layer, so that the image is heat-fixed. This type, however, involves a problem that in order to prevent the off-set of the toner to the heating roller, the temperature of the heating roller is required to be maintained very accurately. To meet this requirement, the heating roller and/or the heater must have a large thermal capacity. If the thermal capacity is not large enough, the temperature of the heating roller significantly changes to higher or lower temperatures due to heat supply from the heat generating member, passage of paper through the nip or other external factors. When the temperature becomes lower, insufficient image fixing and/or low temperature toner off-set results because of insufficient fusing or softening of the toner, whereas if it changed to a high temperature, the toner is too much fused with the result of lowered toner coagulation force, which leads to high temperature toner off-set.

If, in an attempt to avoid these problems, the thermal capacity of the heating roller is increased, the time required for raising the temperature of the heating roller to the predetermined level is increased, with the result of longer waiting time period.

An image fixing apparatus of a different type has been proposed wherein a heat-resistive sheet is used, and the sheet is separated from the image supporting member at a position downstream of a heating position, by which the high temperature off-set does not result even if the toner image is heated to a very high temperature, as disclosed in U.S. Ser. No. 206,767 filed on June 15, 1988 which has been assigned to the assignee of the subject application.

In such a type of image fixing apparatus using the heat-resistive sheet, it is considered that the heat-resistive sheet is in the form of an endless belt. However, it involves a problem. That is, because the distance between the rollers around which the sheet is stretched with the heat generating member interposed therebetween is much shorter than the longitudinal length of the roller due to the structure of the fixing device and because the sheet can be obliquely moved due to an unavoidable positional error of the rollers, the heat-resistive sheet is creased during the movement along the endless path, even to such an extent that the sheet is partly torn.

In order to move the heat-resistive sheet uniformly without production of the crease, a very accurately controlled tension has to be imparted to the sheet, and the tension adjustment is cumbersome work.

It is not easy to produce the endless sheet without seam, having a high cylindricity, from material having high heat resistivity.

In one sheet winding-up system, a non-endless disposable sheet which is exchanged with a fresh sheet after usage is used, and in another system, the sheet is re-usable wherein the sheet is rewound after use-up thereof. The former type involves a problem that the exchanging work is not easy, and also that it is not economical. In the latter type, the sheet is rewound after a number of image supporting sheets are fixed by which the fresh part thereof becomes short. The time required for the rewinding is long, if one roll of the sheet is used up. During the rewinding period, the image forming apparatus can not be operated for the image formation.

The heat-resistive sheet is pressed between the heat generating member and the pressing roller, and therefore, it takes long time, a large torque and high power to rewind it.

SUMMARY OF THE INVENTION

Accordingly, it is a principal object of the present invention to provide an image fixing device and an image forming apparatus wherein the time period required for rewinding the heat-resistive sheet, during which the image fixing operation is disabled is reduced.

It is another object of the present invention to provide an image fixing device and an image forming apparatus wherein the load required for rewinding the heat-resistive sheet is reduced to reduce the torque of the motor for the rewinding.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
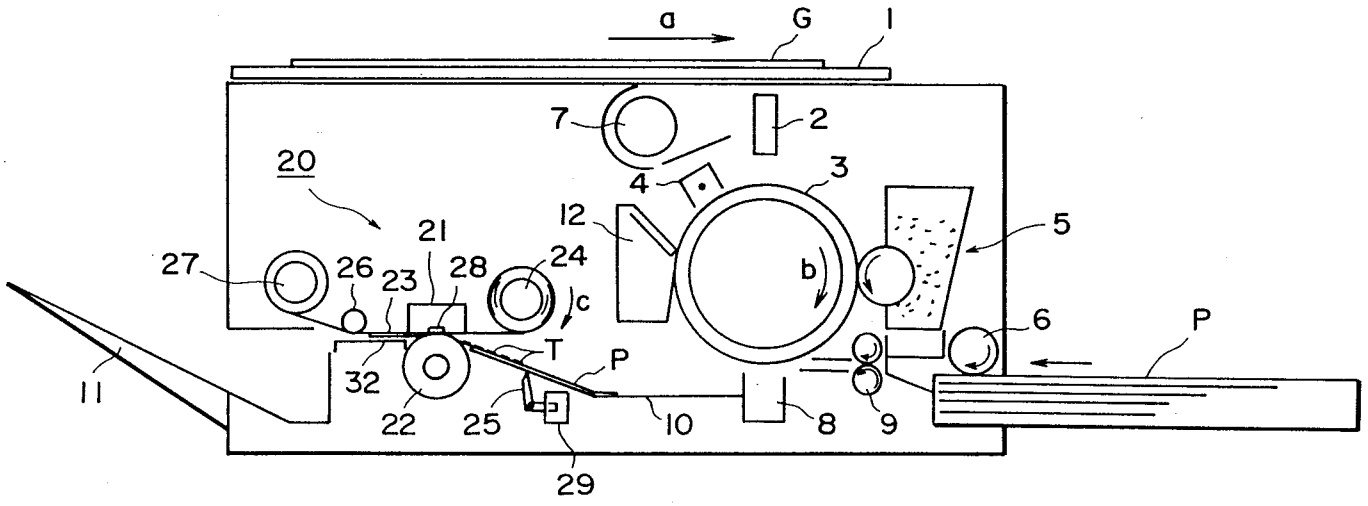
FIG. 1 is a sectional view of an image forming apparatus according to an embodiment of the present invention.

Referring to the drawings, the preferred embodiments of the present invention will be described wherein the same reference numerals are assigned to the elements having the corresponding functions.

Referring to FIG. 1, an image forming apparatus according to an embodiment of the present invention is shown, which is in the form of an electrophotographic machine as an example. The apparatus includes an original supporting platen made of transparent material such as glass, which is reciprocable in the directions a to scan an original to be copied. Below the original supporting platen, an array 2 of short focus imaging elements having a small diameter is disposed. An image G of an original placed on the original supporting plate is illuminated by an illumination lamp 7, and the light reflected by the image is projected onto a photosensitive drum 3 through the array 2 and a slit. The photosensitive drum 3 is rotatable in the direction indicated by an arrow b. A charger 4 serves to uniformly charge the surface of the photosensitive drum 1 coated with zinc oxide photosensitive layer or an organic photoconductor photosensitive layer 3*a*, for example. The surface of the drum 3 uniformly charged by the charger is exposed to image light through the array 2 so that an electrostatic latent image is formed. The latent image visualized by a developer, that is, the toner which is made of resin material which is fused or softened when heated, and is contained in a developer container. A recording medium, that is, a sheet P of the paper in this embodiment, contained in a cassette S is fed to the drum 3 by a feeding roller 6 and a pair of conveying rollers 9 which are press-contacted vertically to feed the sheet for synchronism with the toner image visualized on the photosensitive drum 3. The toner image formed on the photosensitive drum 3 is transferred onto the sheet P by a transfer discharger 8. Thereafter, the sheet P separated from the drum 3 by a known separating means is conveyed along a conveying guide 10 to an image fixing device 20 where the image thereon is heated and fixed. The sheet is then discharged onto a tray 11. After the image transfer, the toner remaining on the drum 3 is removed by a cleaner 12.

The image fixing device 20 will be described. It comprises a heat generating member 21 which includes a base member made of electrically insulative and heat-resistive material such as alumina or the like or made of complex member containing it, and which includes a heat generating surface 28 in the form of a line or a stripe made of $Ta_2N$, for example, and which also includes a protection layer (against sliding movement) on the surface of the heating surface 28, made of $Ta_2O_5$. In this embodiment, the heat generating surface 28 has a width of 160 microns and a length (perpendicular to the sheet of the drawings) of 216 mm. The bottom layer of the heat generating member 21 is smooth, and the front and rear end is rounded to facilitate sliding movement with a heat-resistive sheet 23. The heat-resistive sheet 23 is made mainly by polyester resin which is treated for heat-resistivity and is formed into a sheet having a thickness of approximately 9 microns. The sheet is rolled on a feeding shaft 24 for moment in an unwinding (feeding) direction C and in the opposite direction (rewinding direction). The heat-resistive sheet 23 is contacted to the surface of the heat generating member 21, and is wound on a sheet take-up shaft 27 with the aid of a separating roller 26 having a large curvature.

The heat generating surface 28 of the heat generating member has a small thermal capacity, and is pulsewisely energized to be increased simultaneously in its temperature to approximately 260° C. With the detection of the leading edge of the recording medium T and the trailing edge thereof by a recording medium direction lever 25 and a recording medium detecting sensor 29, the heat generating surface 28 is energized timely. At this time, the energization of the heat generating member may be controlled using a recording material position sensor such as a sheet feed sensor of the image forming apparatus or the like.

A pressing roller 22 includes a core member made of metal or the like and an elastic layer thereon made of silicone rubber or the like. It is driven by an unshown driving source. The recording medium P having an unfixed toner image T conveyed along the conveying guide 10 is closely contacted to the heat generating member through the heat-resistive sheet 23 moving at the same speed as the recording medium P. The conveying speed of the pressing roller 22 is preferably substantially the same as the conveying speed of the sheet during image forming operation, and the moving speed of the heat-resistive sheet 23 is determined correspondingly thereto. With this structure of this embodiment, the toner image made of the heat-fusible toner on the sheet P is first heated by the heat generating member 21 through the heat-resistive sheet 23, by which at least the surface of the toner image is completely softened and fused. Thereafter, the heat of the toner image is radiated, and therefore, the toner image is cooled and solidified again, while the sheet is being separated from the heat generating member 21 and reaching the separating roller 26. By passing by the separating roller 26 having a large curvature, the heat-resistive sheet 23 is separated from the recording material P. In this manner, the toner T is temporarily completely softened and fused, and then is solidified, and therefore, the coagulation force of the toner is very large, so that the toner can behave as a mass. Since the toner is pressed by the pressing roller 22 while it is heated and being softened and fused, the toner image T penetrates into the surface layer of the recording material and is then cooled and solidified. Therefore, the toner is not set off to the heat-resistive sheet 23, and is fixed on the recording material P.

Figure 2:
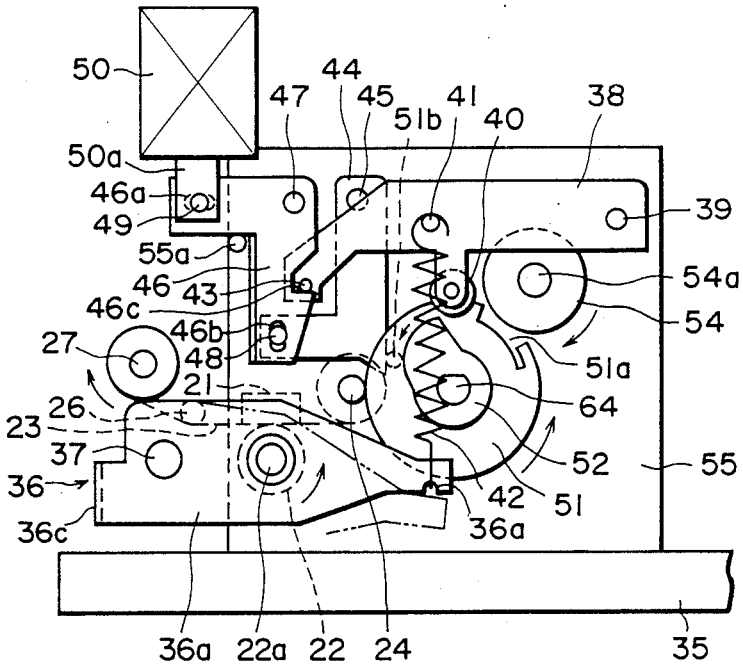
FIG. 2 is a front view of an image fixing device according an embodiment of the present invention.
Figure 3:
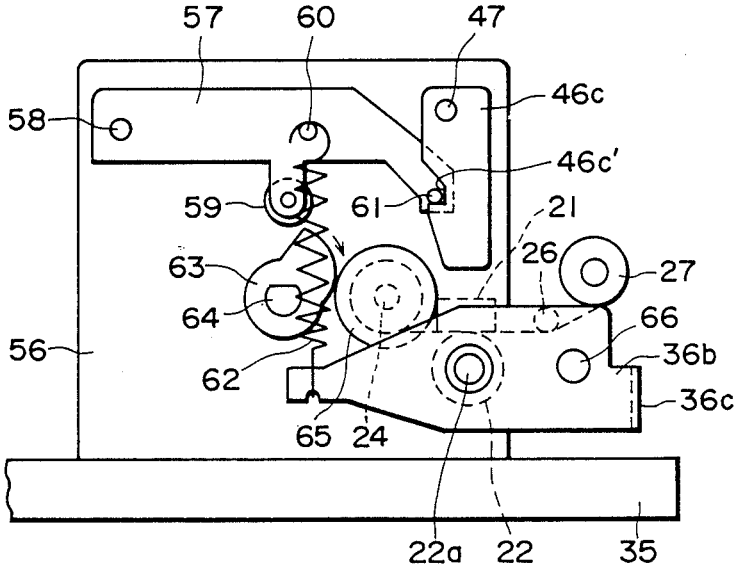
FIG. 3 is a rear view of the same.

Referring to FIGS. 2–6, the image fixing device 20 will be described more in detail. FIG. 2 is a front view of the image fixing device; FIG. 3 is a rear view thereof. The fixing device 20 has a bottom plate 35 and a front plate 55 and a rear plate 56 at longitudinal ends of the feeding or supply shaft 24 and at the ends of the pressing roller 22.

The pressing roller 2 has shafts **22*a* projected from the longitudinal ends thereof which is penetrated through arcuated openings (not shown) which are substantially vertically extended and which are formed in the front plate 55 and a rear plate 56. The penetrated portions thereof are supported by bearings (not shown) mounted on a front lever portion 36*a* and a rear lever portion 36*b* of a roller lever 36. The front lever portion 36*a* and the rear lever portion 36*b* of the roller lever 36 are disposed facing the outsides of the front plate 55 and the rear plate 56 and are connected integrally by a connecting plate portion 36*c* disposed without interference with the discharge of the image-fixed recording medium P. Thus, the roller lever 36 has a channel-like shape. The front lever portion 36*a* and the rear lever portion 36*b* are rotatably supported on supporting shafts 37 and 66 fixed on unshown side plates. By rotating about the shafts 37 and 36, the pressing roller 22 is urged to the heat generating member 21 through heat-resistive sheet 23**, or the contact therebetween is released.

The pressure between the pressing roller 22 and the heat generating member 21 is applied by pressure springs 42 and 62 which are stretched between recesses **36*d* in bottom surfaces of free ends of the front lever portion 36*a* and the rear lever portion 36*b* of the roller lever 36 and pins 41 and 60, respectively. FIG. 2 shows a state wherein the pressing roller 22 is urged to the heat generating member 21 by the spring force through the lower lever 36**.

Figure 4:
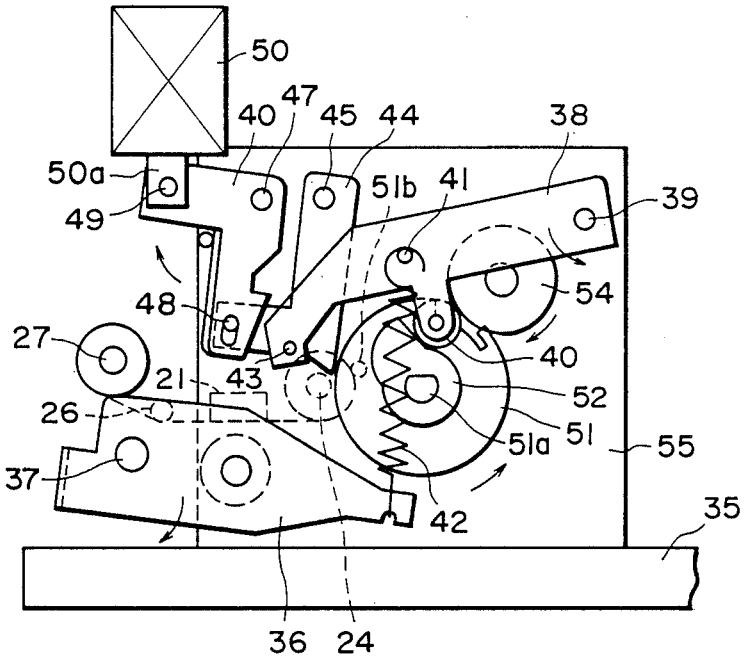
FIG. 4 is a front view thereof in a different state.

On the outside surface of the front plate 55, pins 39 and 45 are planted. To the pin 39, a front latch lever 38 is rotatably supported, and to the pin 45, a positioning lever 44 is rotatably supported. On the outside surface of the rear plate 56, a pin 58 is planted at a position corresponding to the pin 39, and to the pin 58, a rear latch lever 57 is rotatably supported. Between the front plate 55 and the rear plate 56, a lever shaft 47 is extended and is supported by unshown bearings fixed to the respective plates. The portions of the lever shaft 47 have front locking lever 46 and a rear locking lever 46' unrotatably mounted thereto, respectively. The locking levers 46 and 46' are rotatable about the lever shaft 47. The front locking lever 46 has elongated openings **46*a* and 46*b* adjacent its end portions. One 46*a* of the elongated openings is engaged with an engaging pin 49 which is planted in a movable iron core extended downwardly from a solenoid 50 securedly mounted on an unshown plate. The other elongated slot 46*b* is engaged with an engaging pin 48 planted in a free end of the positioning lever 44. When the solenoid 50 is not energized, the movable iron core 50*a* applies by its own weight to the front locking lever 46 the rotational force in the counterclockwise direction about the lever shaft 46. The counterclockwise rotation is limited by a stopper pin 55*a* planted in the front plate 55 at a locking position shown in FIG. 2. The rear locking lever 46' rotates similarly to the lever shaft 47. Adjacent the bottom portions of the front and rear locking levers 46 and 46', inclined surfaces are formed, and above the inclined surfaces engaging recesses 46*c* and 46*c'* are formed. Engaging pins 43 and 61 planted in the free ends of the front and rear latch levers 38 and 57 are engaged with the engaging recesses 46*c* and 46*c'*, by which the lowering movements of the latch levers 38 and 57 are limited to produce predetermined spring forces in the pressing springs 42 and 62. When the solenoid 50 is energized in this state, the movable iron core 50*a* is pulled, as shown in FIG. 4, and the front locking lever 46 rotates in the clockwise direction through the engaging pin 49, and the rear locking lever 46' rotates in the same direction through the lever shaft 47. By this, the engagements between the engaging recesses 46*c* and 46*c'* of the locking levers 46 and 46' with the engaging pins 43 and 61 of the engaging levers 38 and 57, are released. Then, the locking lever 46 and 46' rotate downwardly, and the spring forces of the pressing springs 42 and 62 disappear to be lowered, so that the lever portions 36*a* and 36*b* of the roller lever 36 are also lowered. Therefore, the pressing roller 22 is spaced apart downwardly from the heat generating member 21. At this time, following the clockwise rotation of the front locking lever 46, the positioning lever 44 similarly rotates in the clockwise direction through the engaging pin 48, by which the positioning lever 44 is brought out of contact with a positioning pin 51*b* for a partly cut-away gear 51. Rollers 40 and 59 mounted in the middle portions of the locking levers 38 and 57 are contacted to cams 52 and 63** which will be described hereinafter.

Gear shafts 64 are supported by bearings fixed on the front and rear plates 55 and 56. They penetrate the plates 55 and 56 substantially below the rollers 40 and 49, and the penetrating portions are cut into D-cross-section. To the penetrating portion at the front side, the gear 51 having a cut-away portion **51*a* corresponding to a several teeth at its periphery is fixed. To the penetrating portions, cams 52 and 63 are fixed which have a constant radius profile through approximately 240 degrees. In the rear surface of the gear 51, the positioning pin 51*b* is planted, which pin is effective to abut one end surface of the positioning lever 44 at the locking position shown in FIG. 2 to position the cut away portion 51*a* at a meshing position between the gear 51 and a driving gear 54 which will be described hereinafter, to stop the rotation of the gear 51. At a non-meshing position, the end surfaces of the cams 52 and 63 are obliquely faced to the rollers 40 and 50, as shown in FIGS. 2 and 3. When the latch levers 38 and 57 lower by the release of the locking, the rollers 40 and 59 are contacted to the end surfaces of the cams 52 and 63 to rotate the cams 52 and 63 in the direction of the arrow. The rotations of the cams 52 and 63 rotate the gear 51 in the direction of the allow to be engaged with a driving gear 54**.

The driving gear 54 is rotatably supported by a pin 54a planted in the front plate 55, and is rotated in the direction of the arrow by an unshown motor. By meshing engagement with the gear 51, it rotates the cams 52 and 63. By the contact between the cam surfaces of the cams 52 and 63 and the rollers 40 and 59, the latch levers 38 and 57 are rotated upwardly against the spring forces by the pressing springs 42 and 62, by which the engaging pins 43 and 61 of the latch levers 38 and 57 are brought into engagement with the engaging recesses 46c and 46c' of the locking levers 46 and 46', so that the locked state is established again. The solenoid 50 is energized in a moment when a sheet discharge detecting means for detecting discharge of the recording sheet P after being subjected to the image fixing process and when jamming of the recording medium P is detected. Thereafter, the movable iron core 50a lowers to return the locking levers 46 and 46' to the locking positions. The engaging pins 43 and 61 of the latch levers 38 and 57 rotating upwardly by the cams 52 and 63 are in contact with the inclined surfaces of the locking levers 46 and 46' located at the locking positions, by which the locking levers 46 and 46' are rotated. When they reach the engaging recesses 46c and 46c', the engaging pins 43 and 61 are engaged with the engaging recesses 46c and 46c' by the rotations of the locking levers 46 and 46' by the weight of the movable iron core 50a. In this state, the cut-away portion 51a of the gear 51 reaches the meshing position with the driving gear 54, so that the rotation of the gear 51 is stopped.

The mechanism for bringing the pressing roller 22 into and out of press-contact relative to the heat generating member 21 in the image fixing device according to this embodiment will be described.

Figure 5:
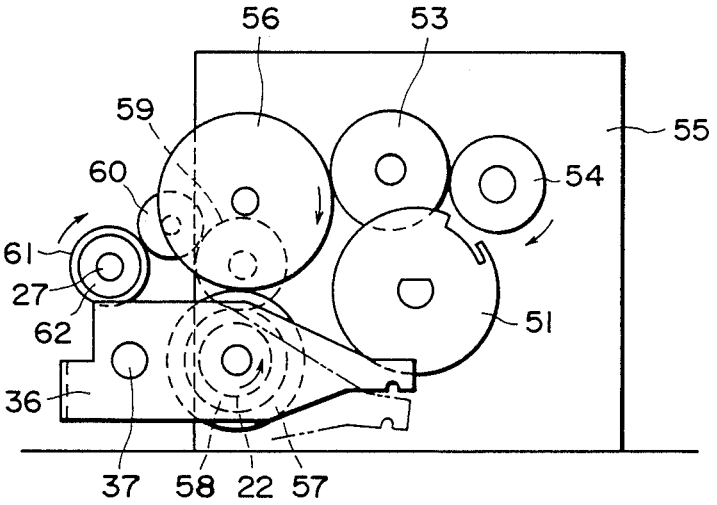
FIG. 5 is a front view of the image fixing apparatus shown in FIGS. 2 and 4, illustrating gears of the image fixing device.
Figure 6:
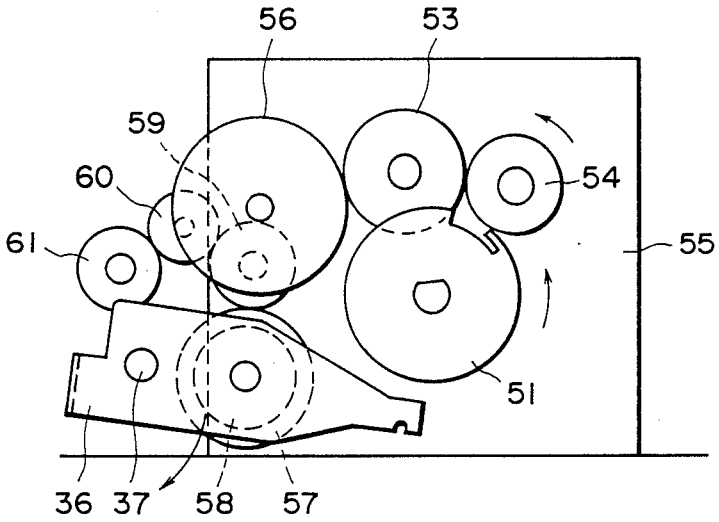
FIG. 6 is same view as of FIG. 5 but in a different state.

Referring to FIGS. 3, 5 and 6, the description will be made as to the drive for the pressing roller 22 and as to the mechanism for moving the heat-resistive sheet 23 from the supply shaft 24 to the take-up shaft 27 and for rewinding the sheet from the take-up shaft 27 to the supply shaft 24.

As shown in FIG. 3, the sheet supply shaft 24 is provided with a spiral spring 65 which is charged by the feed of the heat-resistive sheet 23. The spiral spring 65 is mounted between the take up spool for winding the heat-resistive sheet 23 and the shaft 24a.

The front plate 55 is provided with a first transmission gear 53 always in meshing engagement with the driving gear 54, a second transmission gear 56 meshed with a large pressing roller gear fixed to the shaft of the pressing roller 22 and meshed with the first transmission gear 53, and a third transmission gear 59 meshed with a small pressing roller gear 58 fixed to the same shaft as of the large pressing roller gear 57. By this gear train, the driving force of the driving gear 54 rotating in the direction of the arrow is transmitted to the large pressing roller gear 57 through the first and second transmission gears 53 and 56, thus rotating the pressing roller 22.

On the other hand, the sheet take-up shaft 27 has mounted thereto a take-up shaft gear 61 through a known torque limiter 62 having a compression spring and a friction member. The take-up shaft gear 61 is rotatably supported in an unshown plate, and is meshed with a fourth transmission gear 60 which is meshed with the third transmission gear 59. Therefore, the driving force from the driving gear 53 is transmitted through the driving gear 54, the first transmission gear 53, the second transmission gear 56 and the large pressing roller gear 57, by which the pressing roller 22 is rotated in the counterclockwise direction. It is further transmitted through the small pressing roller gear 58, the third transmission gear 59, the fourth transmission gear, the take-up shaft gear 61 and the torque limiter 62, by which the sheet take-up shaft 27 is rotated in the clockwise direction which is the heat-resistive sheet feeding direction.

In operation, when the recording medium P is discharged after having passed through the image fixing device 20, the above-described heat discharge detecting device is operated to energize the solenoid 50, by which the locking is released, in the manner described in the foregoing. By this, the pressing roller 22 is separated from the heat generating member 21, the engagement between the second transmission gear 56 and the large pressing roller gear 57 and the engagement between the third transmission gear 59 and the small pressing roller gear 58 are released, as shown in FIG. 6. Since the cams 52 and 63 have the same radius over approximately 240 degrees, the unlocking state shown in FIGS. 4 and 6 are maintained for a while until the locking state is resumed. During the maintenance, the heat-resistive sheet 23 wound on the sheet take up shaft 27 is rewound on the supply shaft 24 by the spring force of the spiral spring 65 of the supply shaft 24.

After the rewinding of the heat-resistive sheet 23, the latch levers 38 and 57 are engaged with the locking levers 46 and 46' by the cams 52 and 63, and the pressing roller 22 is again urged to the heat generating member 21 through the heat-resistive sheet 23 with the predetermined pressure provided by the springs 42 and 62, and simultaneously, the driving force is transmitted from the driving gear 54 to the pressing roller 22 and the take up shaft 27, thus performing the image fixing operation for the next recording medium P.

As will be understood, according to this embodiment, when the recording medium P is discharged after having been subjected to the image fixing operation, the solenoid 50 is energized to release the locking engagement between the locking levers 46 and 46' and the latch levers 38 and 57 to separate the pressing roller 22 from the heat generating member 21 to release the press-contact therebetween, and simultaneously, the sheet take-up shaft 27 is freed to permit the sheet 23 to be rewound to the sheet supply shaft 24. When the unlocked state is established, the partly cut-away gear 51 is started to rotate, and during the ending portions of the one full rotation of the gear 51, the latch levers 38 and 57 are locked again with the locking levers 46 and 46' by the cams 52 and 63 to establish the locked state again, thus enabling the image fixing operation to be performed.

In this embodiment, the resetting movement of the locking levers 46 and 46' to the locking positions, is accomplished utilizing the weight of the movable iron core 50a of the solenoid 50, but it is a possible alternative that the locking lever 46 is urged normally to the locking position by a spring.

In this embodiment, the solenoid 50 is energized each time the recording medium sheet discharge detecting device produces a signal, but it may be energized each time a signal corresponding to plural recording sheets is produced.

As described in the foregoing, according to this embodiment, the heat-resistive sheet is rewound while the heat-resistive sheet is not press-contacted to the heating generating member, and therefore, the driving torque of the motor during the rewinding can be reduced, and simultaneously, the heat-resistive sheet which is repeatedly used is not damaged during the rewinding operation.

In addition, after the completion of the rewinding, the pressing roller is automatically reset to the press-contact position, by which improper image fixing operation attributable to the failure of the press-contacted can be avoided.

Figures 7, 8:
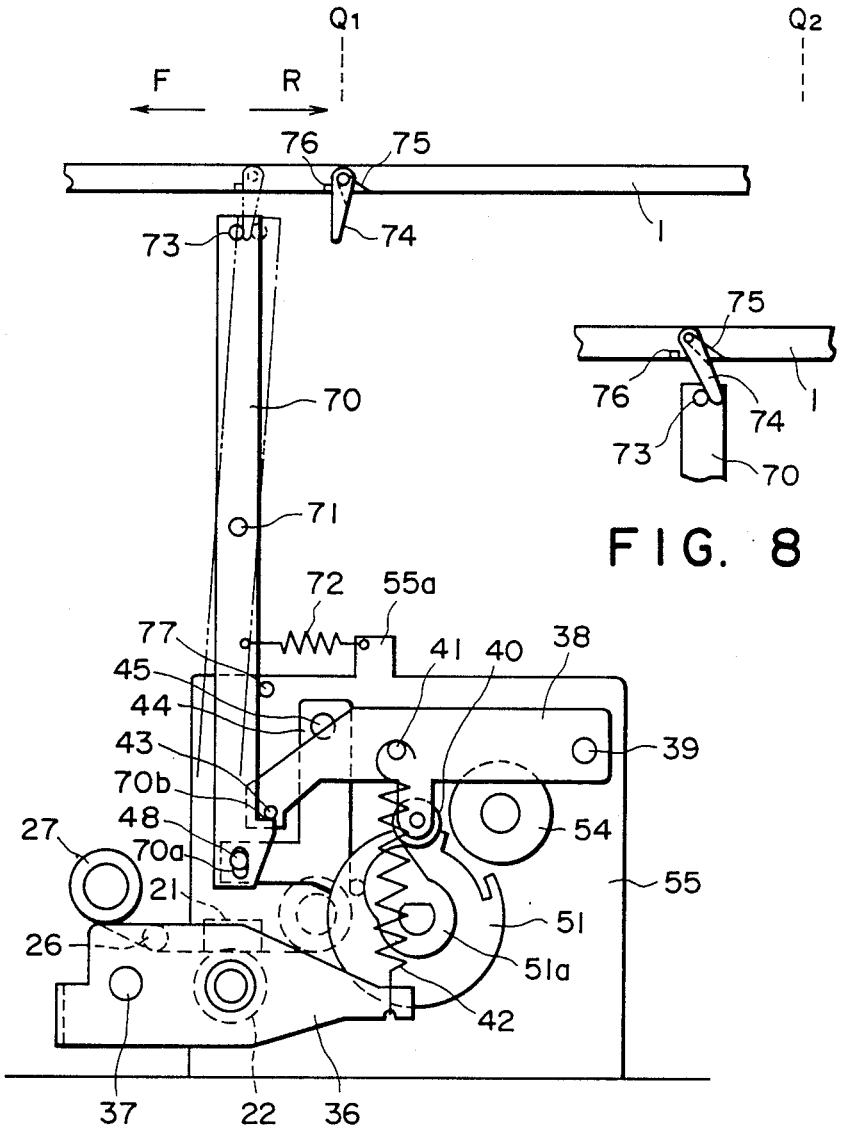
FIG. 7 is a front view of an image fixing device according to another embodiment of the present invention.
FIG. 8 is a front view of a ratchet pawl of the device of FIG. 7.

Referring to FIG. 7, another embodiment wherein the press-contact is removed during the rewinding operation will be described. In the foregoing embodiment, the locking lever 46 is rotated by the energization of the solenoid 50 to establish the unlocked state between the locking levers 46 and 46' and the latch levers 38 and 57. In this embodiment, the use is made of a moving force of a original supporting platen 1 of the image forming apparatus.

A locking lever 70 has a structure similar to the lower portion of the locking lever 46, but the top portion thereof extends to the neighborhood of the bottom surface of an original supporting platen 1 of the image forming apparatus, and is rotatably supported on a pivot pin 71 planted on a side plate (not shown) of the image forming apparatus. It is normally urged in the counterclockwise direction by a spring 72 force between itself and a projection 55*a* of the front plate 55. It is limited in the counterclockwise rotation by abutment to a stopper pin 77 planted in the front plate 55. An elongated slot 70*a* is formed adjacent a bottom portion of the locking lever 70. The elongated slots 70*a* has a stepped portion 70*b* for engagement with an engaging pin 48 of the positioning lever 44 and for engagement with an engaging pin 43 of an engaging lever 38. Adjacent the top end of the locking lever 70, an engaging pin 73 engageable with a ratchet pawl 74 is planted.

Ratchet pawl 74 is rotatably supported on a front end of the original supporting platen 1, and the ratchet pawl 74 is resiliently urged by a weak spring 75. The ratchet pawl 74 is always contacted to an engaging portion 76 provided at the end of the original supporting carriage 1.

The original carriage 1 moves in the direction indicated by an arrow R from the position indicated by Q1 (a pawl 74 functions as an index), during copying operation. It is reversed at the position Q2, and moves in the direction F to read the original to be copied. It reverses again at the position Q3 and stops at the position Q1. When plural copies are to be taken, this operation is repeated.

As shown in FIG. 7, even if the ratchet pawl 74 and the pin 73 are contacted during movement of the original carriage 1 in the direction F, the ratchet pawl 74 simply rotates in the counterclockwise direction, and therefore, the lever 70 is not rotated. However, when the ratchet pawl 74 and the engaging pin 73 of the locking lever 70 are contacted during the movement of the original carriage 1 in the direction R, the locking lever 70 rotates in the clockwise direction as indicated by the chain lines in FIG. 7, by which the locking lever 70 and the engaging pin 43 of the latch lever 38 are disengaged. When the locking lever 70 and the engaging pin 43 are disengaged, the pressure-contact of the pressing roller 22 is released, and the heat-resistive 23 is rewound, and thereafter, the pressing roller 22 is reset to the pressing state, similarly to the embodiment described in the foregoing.

The locking lever 70 is mounted not only on the front plate 55 but also to the rear plate 56. The ratchet pawl 74 is mounted to the rear side of the original carriage 1 and is engaged with an engaging lever 57, similarly to the first embodiment. The pivot pin 71 of the locking lever 70 may be fixedly secured to the locking lever 70, and it may be extended to the rear side, and the extended end may be fixed to another locking lever.

As described, according to this embodiment, no solenoid is used, and the pressure can be removed by the use of the movement of the original carriage, and therefore, the manufacturing cost can be reduced significantly. In the foregoing description, the original carriage 1 is movable, but the present embodiment is applicable to the case where the original carriage is fixed and where an optical system for illuminating the original is moved, by using the movement of the optical system.

Figure 9:
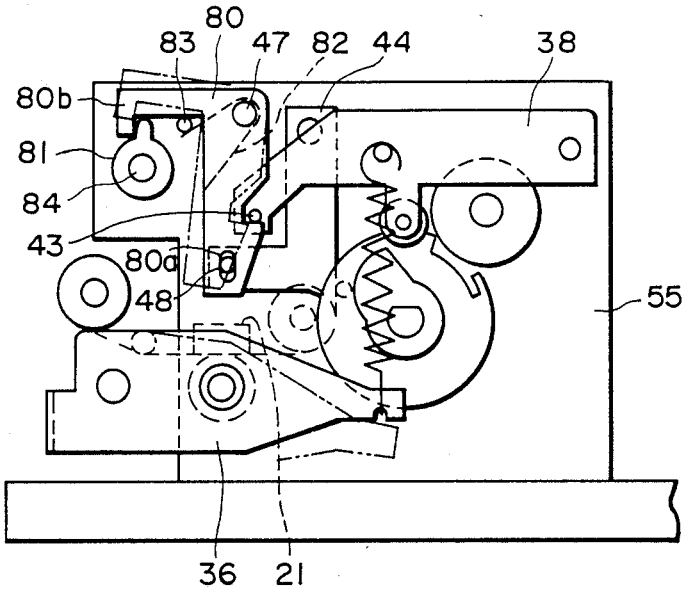
FIG. 9 is a front view of an image fixing device according to a further embodiment of the present invention.

Referring to FIG. 9, a further embodiment will be described, wherein the locking lever 80 is rotatably mounted to a pin 47 planted in the front plate 55, and is normally urged in the counterclockwise direction by an expansion spring 82, and the rotation in the counterclockwise direction is limited by abutment between the locking lever 80 and the stopper pin 83 planted in the front plate 55. Adjacent the bottom end of the locking lever 80, similarly to the first embodiment, there are formed an elongated slot 80*a* for engagement with an engaging pin 48 of the positioning lever 44 and a recess 80*c* for engagement with the engaging pin 43 of the latch lever 38. At the left end of the locking lever 80, the cam portion 80*b*contactable with a cam 81 which will be described hereinafter is formed extending downwardly.

The cam 81 is mounted to the front plate 55 for slow rotation in the counterclockwise direction. When the cam 81 starts to rotate in the counterclockwise direction from the position indicated in the Figure, projected portion of the cam 81 gradually pushes the cam 81*b* so that the locking lever 80 rotates in the clockwise direction as indicated by chain lines. The rotation of the locking lever 80 releases the engagement between the pin 43 and the locking lever 80, and then, the lever 38 lowers to remove the pressure by the pressing roller 22 similarly to the foregoing embodiment. The cam 81 continues to gradually rotate to become spaced apart from the cam portion 80*b*. Thereafter, the locking lever 80 is reset to the initial position to lock the lever 38 to move the pressing roller 22 to its pressing position.

Figure 10:
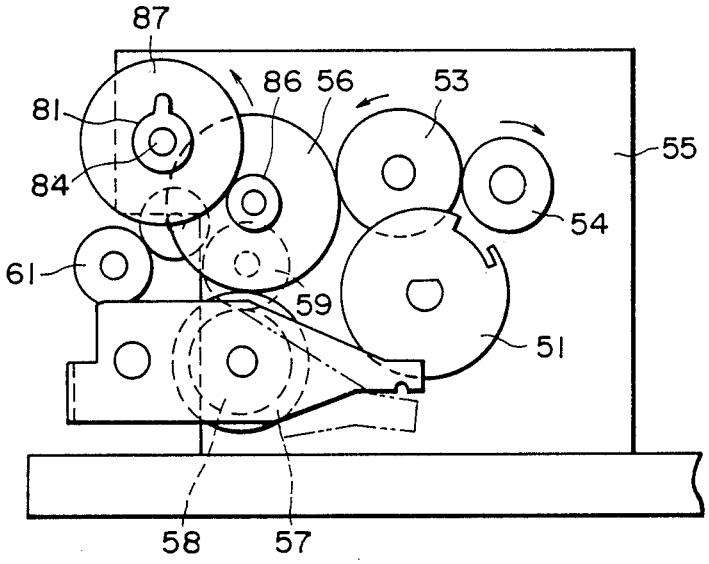
FIG. 10 is a front view of the device of FIG. 9, illustrating gears.

The driving mechanism for the cam 81 is established by meshing engagement between a fifth transmission gear integrally formed with the second transmission gear 56, as shown in FIG. 10 and a cam gear 87 integrally formed with the cam 81. The driving force from the driving gear 54 rotates the cam 81 in the direction of the arrow about the cam shaft 84. The number of rotations of the cam 81 is determined on the basis of the reduction ratio of the gears 86 and 87 and the number of rotations of the pressing roller. More particularly, it rotates through one full turn each time interval of a sum of a time interval $t_1$ from the recording medium being sandwiched between the heat generating member 21 and the pressing roller 22 to the discharge thereof plus a marginal interval (the interval for the post-rotation of the photosensitive drum or the like) $t_2$.

In the foregoing embodiment, the spiral spring is used for rewinding the heat resistive sheet, but this is not limiting and a small size motor may be used. In addition, the heat resistive sheet may be supplied using this small size motor. However, the use of the spiral spring is desirable because no additional driving motor is required.

Figure 11:
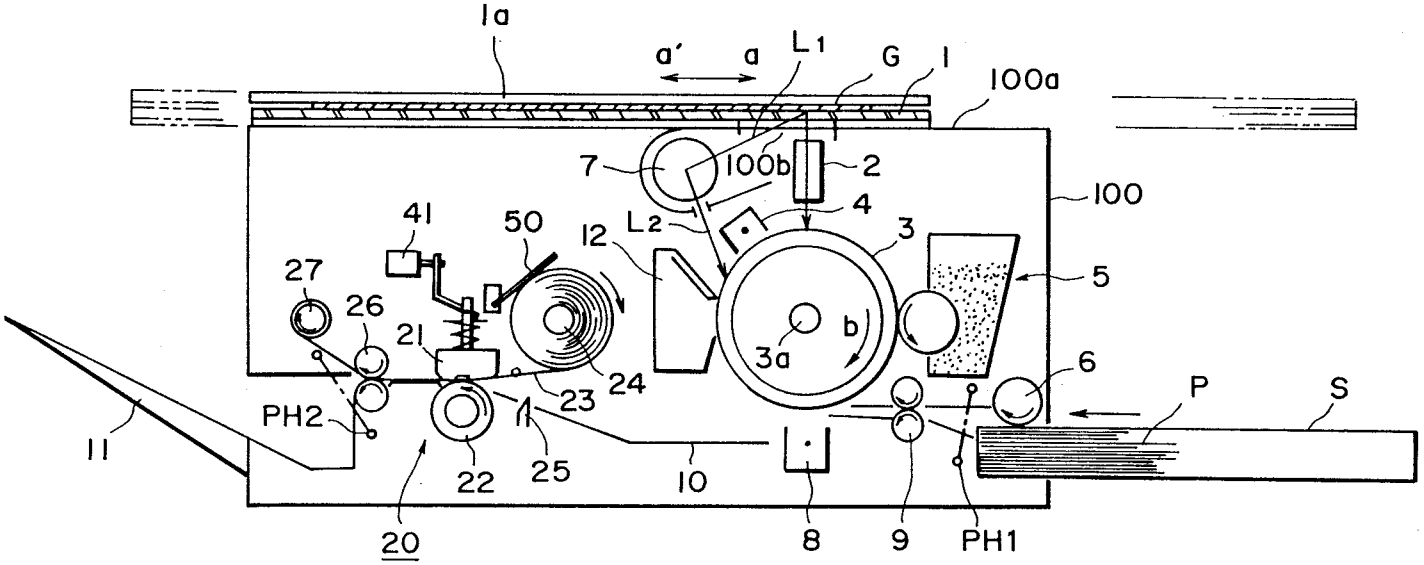
FIG. 11 is a sectional view of an image forming apparatus according to an embodiment of the present invention.

Referring to FIG. 11, a further embodiment of the present invention will be described. This embodiment is similar to FIG. 1 embodiment in the general structure. In FIG. 11, an original carriage is reciprocable in the directions a and a' above the top plate 100*a* of the casing 100 of the apparatus.

An original G is placed face down on the original carriage 1 at a predetermined reference position, and the original cover 1*a* is placed thereon.

A slit opening 100*b* is formed extending in a direction perpendicular to the direction of the reciprocating movement of the original carriage 1 (perpendicular to the sheet of the drawing) on the top plate 100*a*. The image surface (bottom surface) of the original G placed on the original supporting carriage 1 is moved rightwardly so that it passes by the slit opening 100*b* from its right side to the left side. During the passage, the original receives the light L1 from the lamp 7 through the slit opening 100*b* and a transparent original supporting carriage, so that it is optically scanned. The light reflected by the original is imaged on the surface of the photosensitive drum 3 by an array 2 of a short focus imaging elements. The photosensitive drum is supported on the shaft 3*a*. The recording mediums are contained in a cassette S. A sheet detecting sensor (a photosensor, for example) TH1 is disposed in a sheet passage from the feeding roller 6 to the registration roller 9, and a discharge sheet detecting sensor (a photosensor, for example) TH2 is disposed next to the fixing device 20.

Figure 12:
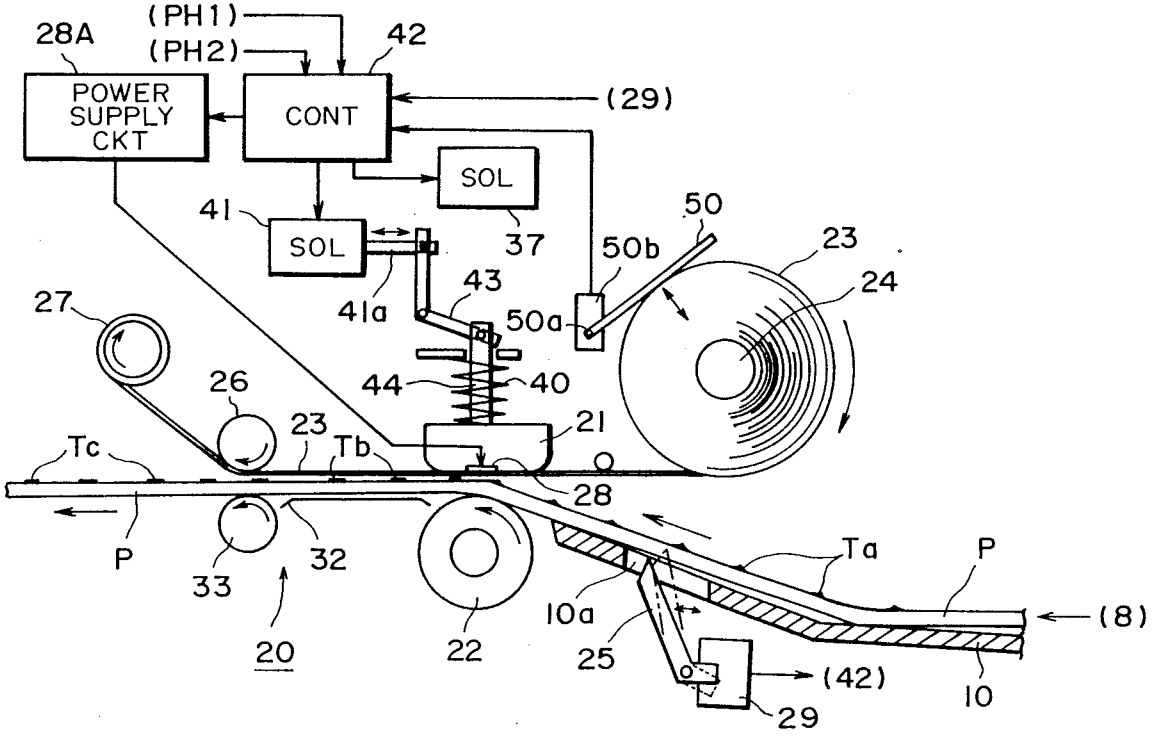
FIG. 12 is an enlarged view of an image fixing device contained in the apparatus of FIG. 11, illustrating the state wherein the image fixing operation is performed.

FIG. 12 shows an enlarged sectional view of an image fixing device used in the image forming apparatus of FIG. 11.

Designated by a reference 21 is a heating member comprising a heat generating resistor 28 in the form of a line or stripe extending in a direction crossing the direction of recording medium conveyance. The heat generator 28 is made of $Ta_2N$ or the like and has a width of 160 microns and a length of 216 mm (in the direction perpendicular to the sheet of the drawing). The surface thereof is coated with $Ta_2O_5$ protection layer, for example, for protection against the sliding action. The heat capacity of the heat generator 28 of the heating member 21 is small. It is pulsewisely energized by an energizing circuit 28A of a control system 24, and the temperature itself instantaneously increases up to approximately 260° C.

Designated by a reference 22 is a pressing roller disposed below the heating member 21, and it comprises a core made of metal or the like and an elastic layer thereon made of silicone rubber or the like. As will be described hereinafter, it rotates forwardly in the counterclockwise direction, and it rotates backwardly in the clockwise direction. The heating member 21 and the pressing roller 22 are presscontacted under a predetermined pressure through a fixing film 23 which will be described in detail hereinafter, or through the fixing film 23 and the recording medium P. In this embodiment, the pressing roller 22 is stationary, and the heating member 21 is movable to be pressed to the pressing roller 22 by a spring 40, thus normally urging it to the heating member 21 to provide a total pressure of 4–6 kg for a width of A4 size, for example.

An electromagnetic solenoid 41 serves to release the pressure contact between the heating member 21 and the pressing roller 22. When the solenoid is energized by the control circuit 42, a plunger 41*a* pulls a lever 43, and separates the heating member 21 through a pulling rod 44 against the spring force of the spring 40, so that the heating member 21 is spaced from the pressing roller 22, as shown in FIG. 3, and the heating member 21 and the pressing roller 22 are maintained at the pressure free state. When the energization of the solenoid 41 is shut off, they are reset to the press-contact state by the spring 40.

The fixing device comprises a supply shaft (rewinding shaft) 24 disposed upstream of the heating member 21 with respect to the recording medium conveyance direction, a take-up shaft for taking up the fixing film, disposed downstream of the heating member 21 and a separation roller disposed between the heating member and the take-up shaft 27 and below the take-up shaft 27. The separation roller has a large curvature (small diameter) and is freely rotatable.

The fixing film 23 is wound on the supply shaft 24, and the leading edge thereof is fixed to the take-up shaft 27 through the nip formed between the heating member 21 and the pressing roller 22 and the bottom surface of the separating roller 26. A sensor arm 50 for detecting remaining amount of the fixing film 23 on the supply shaft 24 is contacted to the outside of the fixing film 23. The fixing film 23 is a single layer film or a multi-layer film with surface treatment or lamination treatment, having a thickness of 9–30 microns, for example. The fixing film 23 has a heat resistivity, a good releasing property relative to the toner and sufficient strength. For example, it may be a polyimide (PI) single layer film having a thickness of approximately 12.5 microns, or a multilayer film provided by coating the single layer film with tetrafluoroethylene (PTFE) resin for providing the releasing layer.

Below the separation roller 26, there is provided by an auxiliary roller which is freely rotatable. A guide plate 32 is disposed between the pressing roller 22 and the auxiliary roller 33. The guide plate 33 is disposed parallel to the fixing film and in light contact with or with a predetermined clearance from, the bottom surface of the fixing film extended between the heating member 21 and the separating roller 26.

A sheet detecting sensor 29 and a sheet detecting lever 25 are disposed in the recording medium conveying guide 10 extending from the toner image transfer station 8 to the fixing device 20, and at a position closer to the fixing device 20. The free end of the lever 25 is projected upwardly through an opening 10*a* of the guide 10. With this state, the sensor 29 is not actuated. When a recording medium (sheet) P is conveyed on the guide 10 from the image transfer station 8 to the fixing device 20, the leading edge of the sheet P kicks the lever 25, by which the lever 25 rotates to go into the opening 10*a*. By this, the sensor 29 is actuated, so that the arrival of the sheet P to the sensor position is detected by the control circuit 42. Since the lever 25 is kept pressed by the bottom surface of the sheet P until the sheet P completely passes by the lever, the lever 25 is kept in the rotated position, and therefore, the actuated state of the sensor 29 is kept. When the trailing edge of the sheet P passes by the lever 25, the lever 25 becomes free again, and its edge projects through the opening 10*a*. By this, the sensor 29 is deactuated, and the passage of the sheet P by the sensor position is detected by the control circuit 42.

Figure 14:
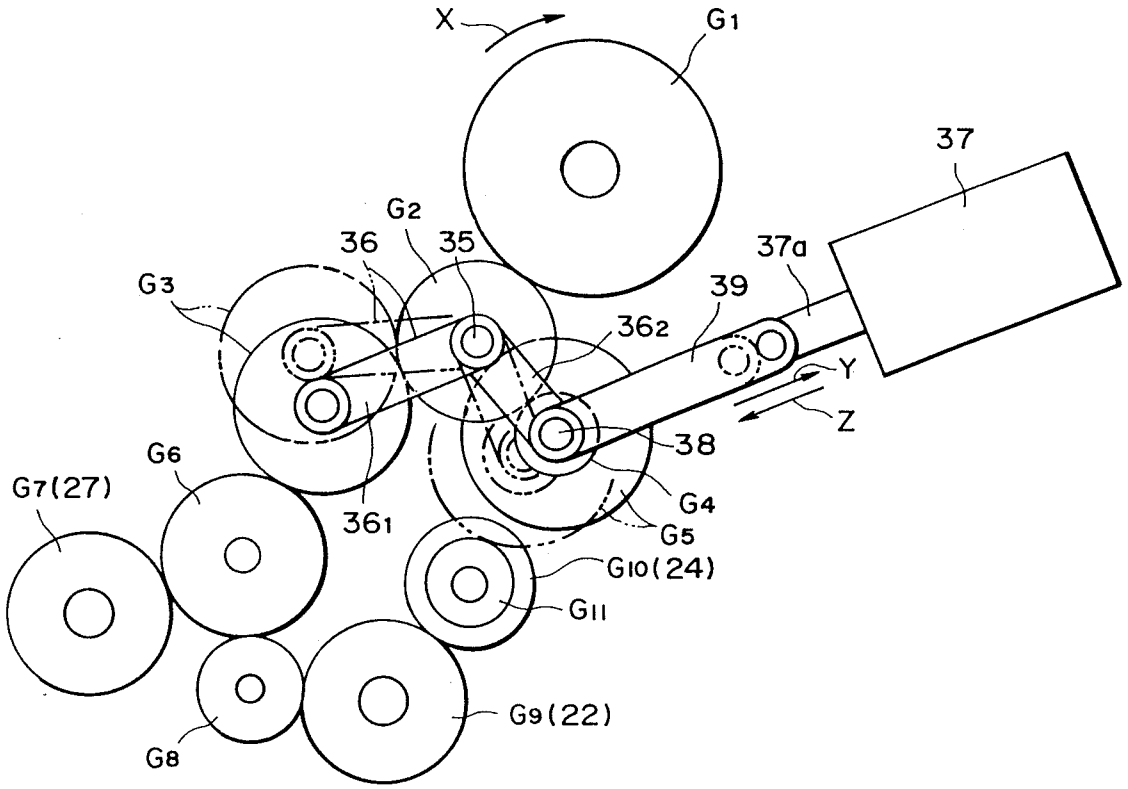
FIG. 14 illustrates a gear train of a driving system.

FIG. 14 shows a gear train of a driving system for forwardly rotating the supply shaft 24, the take-up shaft 27 and the pressing roller 22 (clockwise direction in FIG. 2 for the shafts 24 and 27, and counterclockwise direction for the pressing roller) and for rotating reversely.

A first gear G1 is a driving gear and is driven at a predetermined peripheral speed by an unshown driving source in the clockwise direction X. A second gear G2 is meshed with the first gear. Third and fourth gears are planetary gears cooperable with the second gear G2. The third and fourth gears are supported on a first arm $36_1$ and a second arm $36_2$ of a lever 36 rotatably supported on a shaft 35 of the second gear G2, and the third and fourth gears are meshed with the second gear G2. The gear train further comprises a fifth gear G5 integral with the fourth bear G4, a sixth gear G6 disengageably meshing with the third gear G3, seventh and eighth gears G7 and G8 meshed with the sixth gear G6, ninth and tenth gears G9 and G10 meshed with the eighth gears G8 in series, and a eleventh gears G11 integral with the tenth gear G10. The fifth gear G5 is engageable with the eleventh gear G11.

The seventh gear G7, the ninth gear G9 and the tenth gear G10 are driving gears for the take up shaft 27, the pressing roller 22 and the rewinding or supply shaft 24. An electromagnetic solenoid 37 has a plunger 37*a* having an end which is connected by a link 39 with a central shaft 38 of the fourth gear G4 supported on the second arm $36_2$ of the lever 36.

When the plunger 37*a* is retracted in the direction Y, the lever 36 rotates in the counterclockwise direction about the shaft 35, by which the third gear G3 is meshed with the sixth gear G6, as shown by solid lines, whereas the fifth gear G5 is disengaged from the eleventh gear G11. This is called a first state.

On the contrary, when the plunger 37*a* advances in the direction X, the lever 36 rotates in the clockwise direction about the shaft 35, by which the third gear G3 is disengaged from the sixth gear G6, as shown by chain lines, whereas the third gear G5 is brought into engagement with the eleventh gear G11. This is called a second state.

The plunger 37*a* is normally maintained in the retracted position, and therefore, the gear train is maintained in the first state shown by the solid line. In the first state, when the first gear G1 is driven in the clockwise direction X, the rotational driving force 11 is transmitted through the gear G2, the gear G3, the gear G6 and the gear G7, so that the rewinding shaft 27 is rotated in the forward direction. In addition, the rotation of the gear G6 is transmitted to the gear G9 through the gear G8 to rotate the pressing roller 22 in the forward direction. Further, the rotation of the gear G9 is transmitted to the gear G10 to rotate the supply shaft 24. Thus, by the forward rotations of the take-up shaft 27, the pressing roller 22 and the supply shaft 24, the fixing film 23 is advanced at a predetermined speed from the supply shaft 24 to the take-up shaft 27. The predetermined speed is the same as the speed of the recording medium P on which the image is to be fixed.

The seventh gear G7 for driving the take-up shaft 27 is connected to the take-up shaft 27 through a slip mechanism, so that the peripheral speed of the take-up shaft 27 is slightly larger than the peripheral speed of the pressing roller 22. Therefore, the fixing film advanced at the predetermined speed by the pressing roller 22 is taken up with the predetermined stretching force provided by the slip mechanism. The take-up shaft 27 is further provided with a braking member in which the braking load is changeable by changing pressure to a friction plate, and the braking load is made small during the film take-up operation.

The tenth gear G10 for driving the supply or rewinding shaft 27, similarly to the seventh gear G7, is coupled with the shaft 24 with a slip mechanism, and is provided with a braking member. When the film is rewound, the braking load is increased to apply tension to the film. The tenth gear G10 drives the supply shaft 24 so that the peripheral speed of the shaft 24 is larger than the peripheral speed of the pressing roller 22, but the slipping mechanism operates with the aid of the braking force by the braking member, so that the supply shaft 24 rotates following the speed at which the fixing film is advanced by the pressing roller 22.

With this structure, in this embodiment, even if the fixing film 23 is a thin film, a proper stretching force is applied while it is forwardly moved, so that the film can be taken up without production of crease.

When the plunger 37*a* moves forwardly Z, the gear train is shifted to the second state indicated by the chain lines, the first gear G1 is driven in the clockwise direction X, and then the rotational driving force of the first gear G1 is transmitted through the second gear G2, the fourth gear G4 and the fifth gear G5 and through the gears G11-G10-G9-G8-G6-G6, that is, in the opposite direction to the case of the film taking up operation, so that the supply shaft 24, the pressing roller 22 and the take-up shaft 27 are driven backwardly, by which the fixing film 23 is rewound from the take-up shaft 27 to the supply shaft 24.

In this embodiment, the fourth and fifth gears G4 and G5 constitute a stepped gear having a small diameter portion and a large diameter portion, and the tenth and eleventh gear G10 and G11 constitute a stepped gear having a large diameter portion and a small diameter portion. By this, the rotational speed during the reverse rotation of the supply shaft, the pressing roller 22 and the take-up shaft 27 are larger than those at the time of the forward rotation. This speeds up the film rewinding operation. In addition, the braking load of the supply shaft 24 is reduced, and the braking load to the take-up shaft 27 is increased. Therefore, the film can be rewound without production of the crease, similarly to the case of the film take up or supply operation, and in addition, the film can be rewound in a short period of time.

In operation, the gear grain (FIG. 14) of the driving system of the fixing device 20 is in the first state in which the first gear G1 is not rotated, and therefore, the take-up shaft 27, the supply shaft 24 and the pressing roller 22 are not rotated.

When the image formation start switch is depressed, the sheet P in the cassette S is supplied by the feed roller 6, and the sensor TH1 detects the supplied sheet. The image formation is performed on the photosensitive drum 3. In the image fixing device 20, the first gear G1 in the driving system (FIG. 14) is started to rotate (X) at the time when a predetermined timer period passes from the sheet detection by the sensor TH1, that is, after the passage of time required for the sheet P supplied from the cassette S to pass through the registration roller couple 9, the transfer station 8 and the guide 10 reach the neighborhood of the nip between the heating member 21 and the pressing roller 22. By the start of the first gear 11, the fixing device 20 is brought into a take-up drive state wherein the fixing film 23 advances in the forward direction at the same speed as the sheet P conveyance. The heat generating member 28 is actuated in proper timed relation with arrival of the sheet P leading edge at the sensor lever 25 and the passage of the trailing edge thereof by the sensor 29.

During the driving state, the leading edge of the sheet P smoothly enters the nip formed between the fixing film 23 being advanced and the pressing roller 22 being forwardly rotated. Then, the top surface of the sheet P carrying the unfixed toner image Ta is closely contacted to the bottom surface of the fixing film 23 being moved in the forward direction, without sliding therebetween and without production of crease. The fixing film 23 and the sheet P are kept contacted without sliding therebetween while they are being pressed in the nip between the heating member 21 and the pressing roller 22. During the passage through the nip, the unfixed toner image on the recording medium is heated, softened and fused by the heating member through the fixing film, and particularly, the surface portion of the toner image is completely softened and fused because it is heated to far above the fusing point of the toner. In the nip, the heating member, the fixing film, the toner image and the recording medium are properly closely press-contacted by the pressing member to assure the good heat transfer, by which the toner is sufficiently softened and fused in a short period of time, thus providing good image fixing performance. On the other hand, the temperature rise of the recording medium itself is practically very small, and therefore, the energy loss is limited. In other words, the recording medium is, in effect, not heated, but only the toner is heated sufficiently to soften and fuse it, and therefore, the toner image can be heated sufficiently with low consumption of the electric power.

Here, the description will be made with respect to the softening and fusing of the toner. The "fusing point" of the toner means the minimum temperature required for the toner to be fixed, and it covers the temperature at which the viscosity decreases to such an extent that it can be said "fused", and the temperature at which the viscosity decreases only to such an extent that it can be said "fused". Therefore, when it is said that the toner is "fused", it can refer to "softened". The present invention covers this case. Similarly, when it is said that the toner is "solidified", it can mean the case where the viscosity becomes sufficiently high although it is not completely solidified. The present invention covers this case, too.

Figure 15:
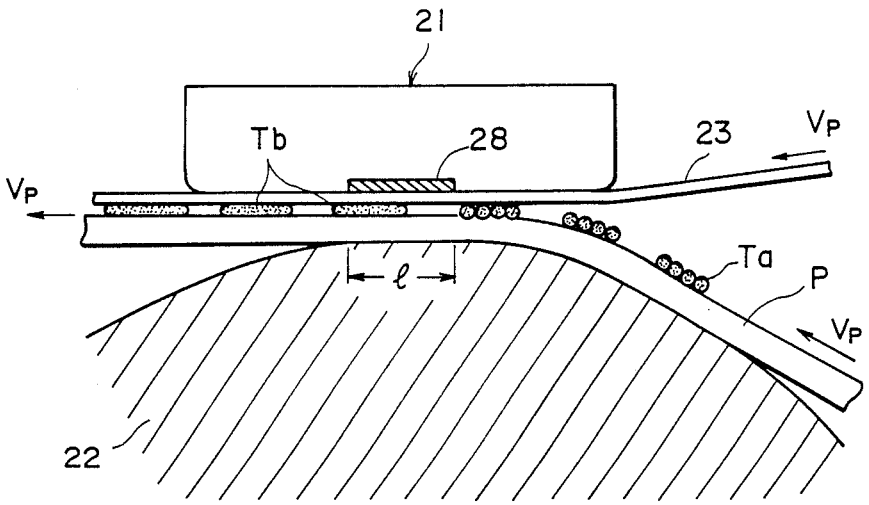
FIG. 15 is a somewhat schematic enlarged view of a nip between the heating member and the pressing roller.

In the heating process of the present invention, the heating member 21 is provided with a linear heat generating member 28 integrally formed, and the low thermal capacity heat generating member 28 is pulsewisely energized. As shown in FIG. 15, the toner image Ta on the sheet P advanced at a speed Vp (mm/sec) is introduced to an effective width 1 of a linear heating portion together with the fixing film 23 advanced without slide therebetween, and is thus heated to be softened and fused into a softened or fused image Tb, the effective width being determined by the width of the heat generating element 28 of the heating member 21.

Figure 16:
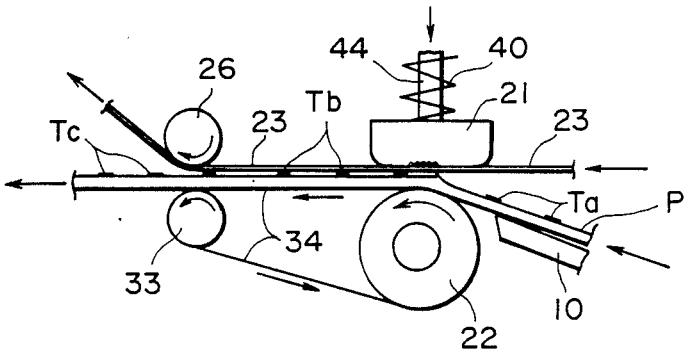
FIG. 16 shows an example wherein a guide belt is stretched around the pressing roller and an auxiliary roller.

The portion of the sheet having passed through the nip between the heating member 21 and the pressing roller 22 is conveyed with the fixing film 23 with close contact therebetween until it reaches the separating roller 26. The guiding plate 32 functions to support the backside of the sheet P to maintain the close contact thereof with the fixing film 23. In place of the guiding plate 32, a rotating guiding belt 34 may be stretched between the pressing roller 22 and an auxiliary roller 33 to support the backside of the sheet P to maintain the close contact between the fixing film 23 and the sheet P, as shown in FIG. 16.

This conveyance of the sheet P provides a cooling process in which the heat of the softened or fused toner Tb is radiated, so that the toner is cooled and solidified into a solidified image Tc.

When the sheet reaches the separation roller 26, the fixing film 23 is separated from the surface of the sheet P along the outer periphery of the separation roller 26 having the large curvature, and therefore, the fixing film 23 and the sheet P are advanced in different directions. The sheet is discharged onto the discharge tray 11. By the time of reaching the separation point, the toner is sufficiently cooled and solidified so that the adherence and the fixing of the toner to the sheet P are sufficiently strong, whereas those to the fixing film 23 is already extremely small. Therefore, the separation of the fixing film 23 and the sheet P occurs sequentially without difficulty and without substantial occurrence of the toner offset to the fixing film 23.

The advance of the fixing film 23, that is, the taking-up operation terminates by stoppage of the first first G1 when the sheet P has passed through the fixing device 20, and the trailing edge thereof is detected by the discharge sheet detection sensor TH2.

In this embodiment, the fixing film 23 is taken up from the supply shaft 24 to the take-up shaft 24 at the same speed as the conveyance of the sheet P each time the execution of the image fixing operation to the sheets P.

The control of the forward drive of the fixing film may be in the following manner. From the point of time at which the sheet detecting sensor TH1 detects the sheet, the first timer period is counted at which the fixing film drive is started, and then, the drive is stopped at the elapse of second timer period. During this period, the image fixing operation is performed to the sheet P. In this case, the sheet discharging sensor TH2 is not used. As a further alternative, the driving is controlled in response to the detections of the leading edge and the trailing edge of the sheet P by the sensor 29 and the lever 25.

Next, the description will be made as to the rewinding of the fixing film. The sensor arm 50 for detecting the remaining amount of the rolled fixing film 23 is contacted to the outer periphery of the fixing film 23 rolled on the supply shaft 24, and therefore, it becomes inclined more in the clockwise direction about the pin **50*a* with the taking-up operation from the supply shaft 24 to the take-up shaft 27 resulting in the decrease of the diameter of the roll of the fixing film 23 on the supply shaft 24**.

When the fixing film 23 on the supply shaft 24 is consumed to the extent of near end, and the arm 50 reaches a predetermined inclination, a signal indicative of the shortage of the fixing film 23 is transmitted from the sensor **50*b* to the control circuit 42**.

In response to the signal, the control circuit 42 shut off the energy supply to the heat generating element 28 on the heating member 21 from the energy supply circuit 28A, and the shut-off state is maintained during the film rewinding operation which will be described hereinafter. By the interruption of the energy supply to the heating member during the film rewinding operation, the power consumption, the temperature rise in the apparatus and the thermal deterioration of the fixing film can be reduced.

Figure 13:
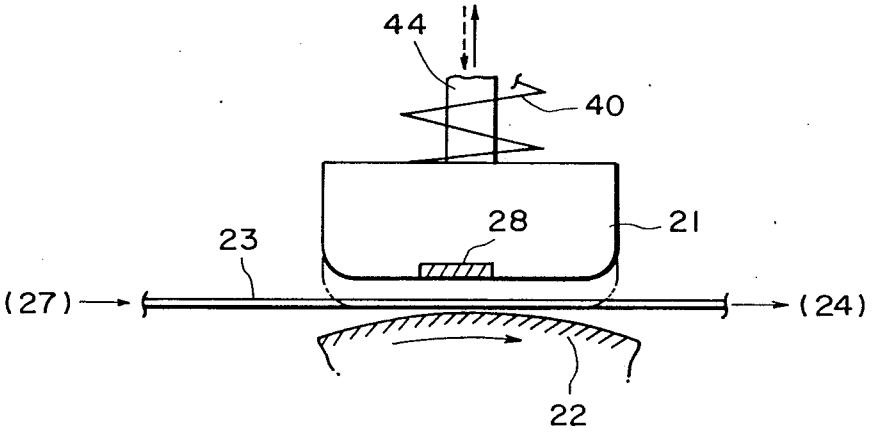
FIG. 13 is an enlarged partial view wherein the contact pressure between the heating member and the pressing roller is released.

Also in response to the above signal, the control circuit 42 energizes the electromagnetic solenoid 41 (the pressure releasing means). As described hereinbefore in conjunction with FIG. 13, this raises the heating member 21 from the pressing roller 22 to be spaced from the pressing roller 22, so that the pressure contact between the members 21 and 22 are stopped. In other words, the pressure to the fixing film 23 by the members 21 and 22 are removed.

The electromagnetic solenoid 37 (FIG. 14) of the driving system is energized to advance the plunger 37 in the direction z. As long as the solenoid 37 is energized, the gear train is maintained at the second state indicated by chain lines in FIG. 14. In this state, the first gear 11 is driven to move the fixing film 23 backwardly, that is, from the take-up shaft 27 to the supply or rewinding shaft 24. In this embodiment, during the backward movement of the fixing film 23, the pressure between the heating member 21 and the pressing roller 22 is removed, and therefore, the rewinding torque is reduced, and the unnecessary frictional movement and possible damage to the heating member 21 and the fixing film 23 can be prevented, so that the durability of the fixing device is enhanced.

When a predetermined amount of the fixing film 23 is rewound on the rewinding shaft 24 to such an extent that the sensor arm 50 rotates in the counterclockwise direction to a predetermined reset angle, a signal indicative of completion of the rewinding operation is transmitted from the sensor **50*b* to the control circuit 42. In response to the signal, the rotation of the first gear G1 is stopped, by which the reverse movement of the fixing film 23 is stopped, and the energization to the solenoid 37** for the gear train is stopped, that is, the gear train is shifted back to the first state.

In addition, the energization to the electromagnetic solenoid 41 (the pressure removing means) is stopped so that the pressure contact is established again between the pressing roller 22 and the heating member 21 through the fixing film 23 therebetween. Then, the fixing device 21 is in the stand-by state.

In this embodiment, during the film rewinding period, warning is made by turning on a lamp or buzzer, for example, and simultaneously, the execution of the copying operation is prohibited in the circuit. The warning, the prohibition of the copying operation and the interruption of the energy supply to the heat generating element are released in response to the above-described signal indicative of the completion of the rewinding. The fixing film 23 rewound on the supply shaft 24 is re-usable for the execution of the image fixing. By the structure wherein the fixing film is advanced forwardly for the execution of the image fixing by the take-up means and the rewinding means, and wherein it is rewound to be reused, the thin fixing film can be stably traveled in the forward and backward direction without production of the crease, so that it can be repeatedly used for a long period of time.

The removal of the contact pressure between the heating member 21 and the pressing roller 22 may be accomplished by moving the pressing roller 22 away from the heating member 21, or by moving both of the heating member 21 and the pressing member 22 away from each other.

The film rewinding operation, in this embodiment, is started at the time when the detecting means **50*a* detects that the fixing film on the supply shaft 24 is taken up on the take-up shaft 27** to the extent of near end. However, this is not limiting, and the following is possible:

(a) It is executed each time the main power switch of the image forming apparatus is turned on:

(b) A period during which the recording sheet is not passing through the fixing device is detected, using the sheet feed signal at the sheet feeding station 6, the sheet discharge signal at the sheet discharge station 11 after the passage of the fixing device 20, and the signals from leading and trailing edge detecting means for the recording medium or the sheet disposed at proper position or positions through a passage extending from the sheet feeding station 6 through the image forming station (transfer station) 8, the fixing device 20 to the sheet discharging station 11; and the rewinding operation is executed during this period or each time the periods:

(c) The film rewinding operation is normally executed, and the forward movement of the fixing film is performed exceptionally when the image fixing operation is performed; and/or (d) Manual switching means is provided, and the film rewinding operation is performed when the manual switch means is actuated.

Figure 18:
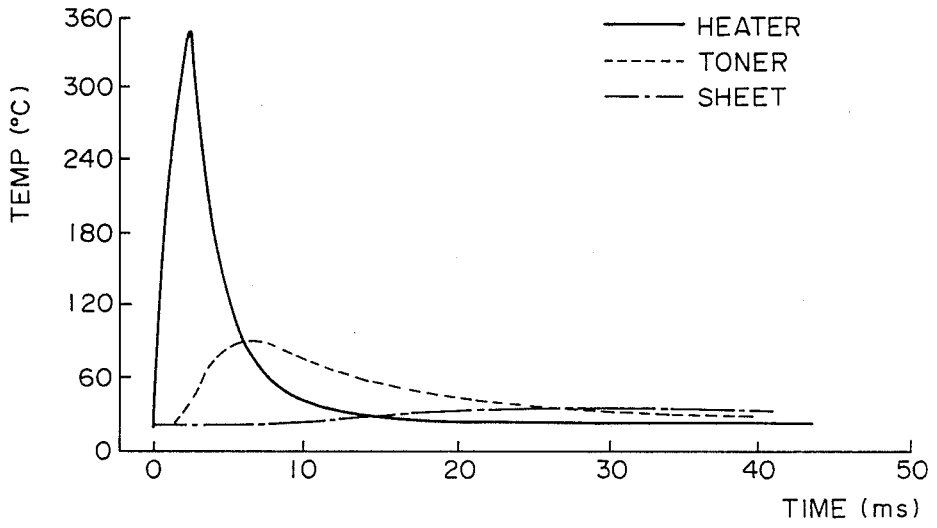
FIG. 18 shows the same temperature changes under a different condition.

FIG. 18 shows the temperature changes with time when a toner image is fixed on a recording medium P using the fixing apparatus according to this embodiment. The calculated temperatures of the surface portion of the heating portion in the effective width, of the middle part of the toner and the middle part of the recording sheet in the thickness thereof.

The conditions are as follows:

Heating condition: heating during 2.5 ms at the energy density of 25 $W/mm^2$
Fixing temperature of the toner: 80° C.
Film: polyimide (25 microns)
Thickness of the toner layer: 20 microns
Thickness of the recording medium: 100 microns
Room temperature: 20° C.

In this example, the toner is heated up to 360° C. which is far higher than the toner fixing temperature of 80° C., and the toner is sufficiently heated beyond the fixing temperature for a very short period, that is, 2 ms with good fixing property.

On the other hand, the temperature rise of the recording sheet is very small, and therefore, the wasteful consumption of the energy is much smaller than conventional heating roller type fixing.

Even when the heating period and the temperature of the heating member vary with the result of excessive energy applied, the high temperature offset does not occur, and therefore, a wide tolerable range is provided.

Figure 17:
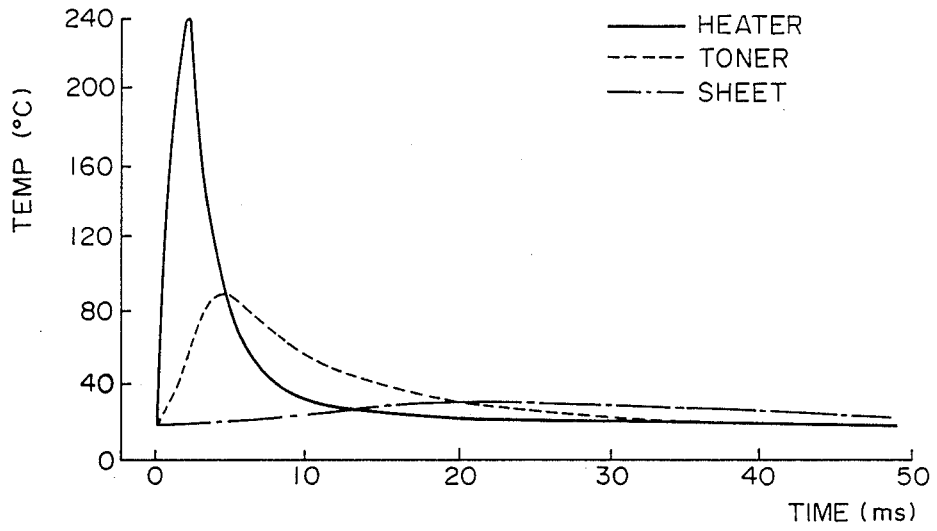
FIG. 17 is a graph showing changes the temperatures of the heating member, the toner and the recording material during the heating step in the apparatus of FIG. 11.

In FIG. 18, the energy density is reduced to 20 $W/mm^2$, and heating period is 2 ms with the thickness of the fixing film changed to 12.5 microns. The other conditions are the same. The results are shown in FIG. 17. The similar good results are provided.

As will be understood from the foregoing, a small size heat generating element (heating member) is sufficient, and therefore, the thermal capacity thereof is small. This eliminates the necessity of pre-heating the heating member. This also reduces the power consumption during the non-image-forming period, and in addition, the temperature rise of the apparatus can be prevented.

In this embodiment, the separation roller 26 is provided so that the cooling period is assured for the heated, softened or fused toner image Tb until the separation roller is reached. Because the separating roller 26 has a large curvature, the separation between the fixing film 23 and the recording material P is made easy. In combination with the above-described advantage, the toner offset at the separating point can be prevented. If, however, the heating portion (heat generating element) 28 and the fixing film 23 have sufficiently small thermal capacity, and if the fixing process speed is small, the particular means such as the separating roller 26 is not necessary, since the heated, softened and fused toner Td is cooled and solidified into the toner Tc in a short range after the passage of the heating portion. In this case, the toner offset is not produced even if the separating roller 26 is omitted. That is, it will suffice if the fixing film 23 can be separated from the recording medium P after the toner image is cooled and solidified after once it is heated, softened and fused.

The image fixing device according to this embodiment was incorporated into a copying machine TPC PC-30 available from Canon Kabushiki Kaisha, Japan using a wax toner. The toner image Ta was fixed at the fixing process speed of 15 mm/sec with the pulsewise heating for 2 ms each 10 ms to provide the heat generation of approximately 3000 J/one A4 size sheet. Then, good image was produced without any practical problem.

By this energization, the heating member 28 was heated up to approximately 260° C. and was sufficiently cooled by interruption of the energization for as short as 8 ms since it had a small thermal capacity. Therefore, the waiting period for heating the heating member 21 is not necessary. In the above case, the temperature of the toner image exceeded, instantaneously though, the temperature which is said to result in the high temperature offset. However, since the fixing film 23 was separated from the recording medium P only after the toner was sufficiently cooled and solidified, the toner offset did not result. The fusing point of the wax which is a major component of the toner used was approximately 80° C., and the viscosity when it is fused is low, and therefore, when it was heated by the heat generating element 28 up to approximately 260° C., the toner was impregnated too much with the result of smear or impregnation to the backside in the conventional heating fixing device this has been an obstruction of lowering the toner fusing point. In this embodiment, the inclination of the temperature change is steep because of the small thermal capacity of the heat generating element 28 and the short heating period, and therefore, the surface layer of the recording sheet is heated only for a short period, and therefore, it is substantially free from the above problems attributable to the excessive toner impregnation.

In the foregoing description, the image forming apparatus has been of an image transfer type electrophotographic copying machine. However, the present invention is applicable to the image forming process wherein a toner image is formed and carried directly on an electrofax sheet or an electrostatic recording sheet, or to a process wherein an image is formed with heat fusible toner by a various image forming process such as magnetic recording process. Examples of these machines are copying machine, a laser beam printer, a facsimile machine, a microfilm reader-printer, display apparatus, another recording machine or the like.

The description will be made as to the film rewinding timing in this embodiment.

Figure 19:
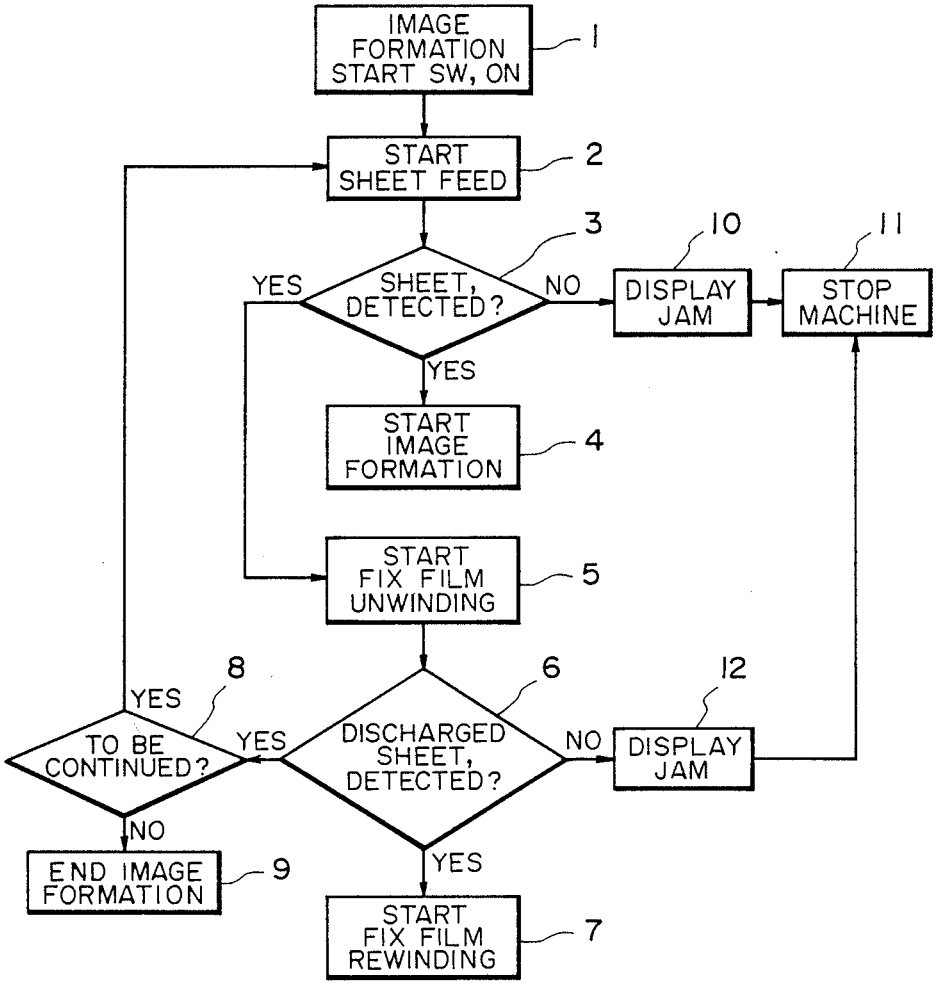
FIGS. 19 and 20 are flow charts illustrating an operation of the apparatus according to the embodiments of the present invention.

FIG. 19 is a flow chart illustrating operation and control of the image forming apparatus including the rewinding operation. The gear train (FIG. 14) of the driving system of the fixing device 20 is normally in the first state described above, wherein the first gear G1 is not rotated, and therefore, the take-up shaft 27, the supply shaft 24 and the pressing roller 22 are not rotated.

When the image formation start switch is depressed at step 1 in FIG. 19, the sheet P is fed out of the cassette S by the feeding roller at step 2, and the sheet is detected by the sensor TH1 (yes, at step 3). The image formation on the photosensitive drum 3 is started at step S4. When a predetermined timer period elapses from the sheet detection by the sensor TH1, that is, when the time period elapses which is required for the sheet P fed out of the cassette S passes through the registration roller couple 9, the transfer station, the guide 10 to reach the neighborhood of the nip formed between the heating member 21 and the pressing roller 22, the first gear 11 of the driving system (FIG. 14) is started. By this, the fixing film 23 is advanced in the forward detection at the same speed as the sheet P (at step 5). The heat generating element 28 is energized at proper timing on the basis of the detection of the leading edge of the sheet P by the sensor lever 25 and the detection of the passage of the trailing edge by the sensor 29.

If the sensor TH1 does not detect the sheet even after the passage of the predetermined timer period after the start of the sheet feed (step S2), no at step S3, the failure of the sheet feed is displayed on a console panel not shown, at step 10, and the image forming apparatus is stopped, at step 11.

By the start of the operation of the fixing device 20 (step 5), the leading edge of the sheet P conveyed to the fixing device 20 from the image transfer station 8 through the guide 9 is smoothly introduced into the nip formed between the fixing film 23 advancing in the forward direction and the pressing roller 22 rotating in the forward direction. The top surface of the sheet P carrying the unfixed toner image Ta is closely contacted to the bottom face of the fixing film 23 also advancing in the forward direction, and therefore, the sheet is passed through the nip together with the fixing film 23 without sliding movement therebetween and without production of the crease. The sheet P introduced into the fixing device 20 is subjected to the heating, cooling and separating steps. When the trailing edge of the sheet P is separated from the fixing film 23 advancing in the forward direction toward the take-up shaft, the passage of the trailing edge of the sheet is detected by the discharge sheet detecting sensor TH2 (yes, at step 6). Then, in response to the signal, the rewinding operation of the fixing film 23 is started at step 7. In the film rewinding operation, the electromagnetic solenoid 41 functioning as the pressure removing means is energized in response to the discharge sheet signal. And, the electromagnetic solenoid 37 in the driving system is also energized.

When the completion of the film rewinding from the take-up shaft 27 to the supply or rewinding shaft 24 is detected by an unshown detecting means, the energization of the electromagnetic solenoid 41 and the energization of the electromagnetic solenoid 37 are shut off, so that the driving gear, that is, the first gear G1 is stopped.

When the image formation is performed in a continuous image formation mode (multi-copy mode) (yes, at step 8), the sequence goes back to the step 2 (sheet feed start), and the operational cycle through the steps 2–8 are repeated the number corresponding to the set number.

In the film rewinding process at step 7, in this embodiment, the rewinding operation is performed at a speed higher than the film taking up speed by the driving system shown in FIG. 14. The total length of the film may be short. For those reasons, the rewinding operation is completed by the time when the next sheet is supplied, and the leading edge of the next sheet enters the fixing device 20. Therefore, the image forming process speed is not lowered.

After the sheet discharge is detected in the single image formation mode (mono-copy mode), or after the final sheet discharge is detected in the continuous image formation mode (no, at step 8), the image formation is completed (step 9). The rewinding operation of the fixing film is completed, and the energizations to the solenoid 41 and 37 are shut off, and the drive of the first gear G1 is stopped. Also, the energy supply to the heating element 28 of the heating member 21 is kept shut off, so that the fixing device is in the stand-by state.

Regarding the discharge sheet detection at step 9, if the discharged sheet is not detected (no, at step 9), even after a predetermined timer period elapses from the fed sheet detection at step 3 or from the detection of the leading or trailing edge of the sheet by the sensor 25 or 29, the failure of the sheet conveyance is displayed on the console panel, at step 12. At this point of time, the operation of the image forming apparatus is stopped at step 11. When the apparatus is stopped due to the failure of the sheet conveyance and the failure of the sheet feeding at step 12 and at the above-described step 10, the recovery operation is performed, and the presetting switch is actuated. Then, the image forming operation is resumed after the image formation start switch is depressed.

The fixing film is repeatedly usable for the image fixing operation, and the fixing film is used for the image fixing operation by the film taking-up means and the film supply means to advance it in the forward direction, and is rewound by the backward movement to permit repeated use in the manner described above. Therefore, the thin fixing film can be moved in the forward and backward directions without production of the crease, and therefore, it can be repeatedly used for a long period of time.

By rewinding the fixing film each time the fixing operations, particularly by executing the rewinding operation at least each time the period which is after the image fixing operation is executed to one recording medium, and the trailing edge of the recording medium is separated from the fixing film and before the leading edge of the next recording medium is introduced into the fixing means, the length of the film can be reduced to minimum, and therefore, the size of the image forming apparatus can be reduced, and also the cost thereof can be reduced.

The start timing of the film rewinding operation is determined in the above example on the basis of the discharge sheet detection signal by the discharge sheet detecting sensor TH2. It is a possible alternative that a timer is actuated at the time of the detection of the sheet by the sensor TH1, and the sheet rewinding operation can be started at the time when a predetermined timer period elapses from the detection by the sensor TH1, the timer period being determined on the basis of the time required for the sheet to be discharged to the discharging tray 11.

The pressure removing between the heating member 21 and the pressing roller 22 during the film rewinding operation, and pressing roller 22 may be moved away from the heating member 21, as in FIGS. 2 -6, or both of the heating member 21 and the pressing roller 22 are moved away from each other.

Figure 20:
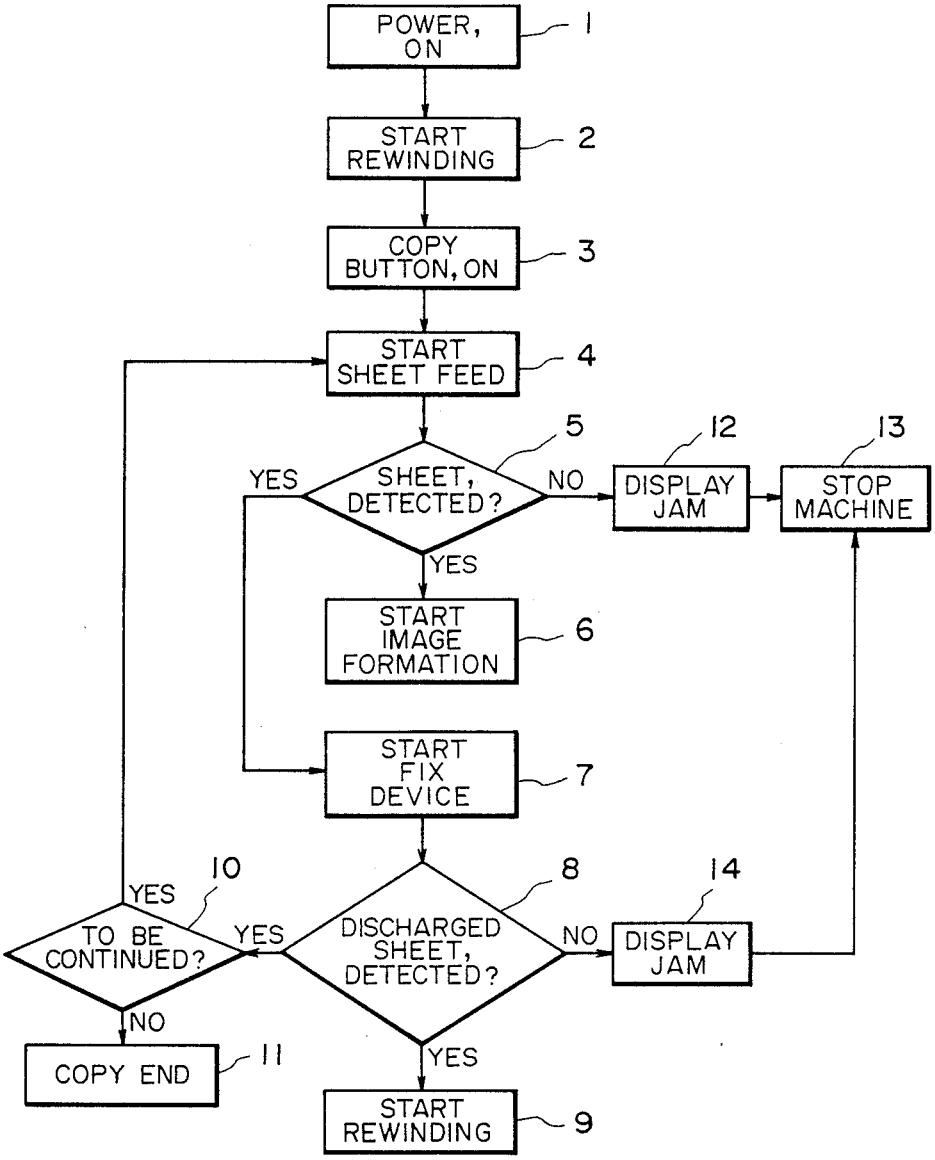

Referring to FIG. 20, another embodiment will be described wherein the fixing film is rewound at different timing.

When the main switch is turned on at step 1, the rewinding operation of the fixing film is executed at step 2. In response to the main switch actuation signal, the control circuit 42 (FIG. 12) makes the solenoid 37 (FIG. 14) operate to advance the plunger 37*a* thereof in the direction Z, so that the gear train of the driving system is shifted in the second state indicated by chain lines in FIG. 14, and the state is maintained. Also, the first gear G1 (driving gear) is started to rotate in the direction X. In addition, the electromagnetic solenoid 41 (FIG. 12) functioning as the pressure removing means is energized, by which the heating member 21 is displaced upwardly away from the pressing roller 22, as described hereinbefore in conjunction with FIG. 13, so that the pressure contact therebetween is released. In other words, the pressure contact of the fixing film 23 with the member 21 and the member 22 is removed. With this state kept, the portion of the fixing film which has been taken up on the take-up shaft 27 from the supply shaft 24 by the use of the apparatus before the above main switch actuation, is rewound.

When the completion of the film rewinding operation is detected, the lamp or the like indicating the execution of the film rewinding operation is turned off, so that the prohibition of the image forming operation is stopped, and therefore, the image forming apparatus is enabled to perform the image forming operation.

Then, the copy button (image formation starting switch) is actuated at step 3, by which the sheet feeding roller 6 is driven to feed the sheet P in the cassette S at step 4. Whether the sheet is actually fed or not is detected by the fed sheet discharge sensor TH1 at step 5. When the sheet is detected, the image forming operation on the photosensitive drum is started in response to the detection signal (step 6), and the driving of the fixing device 20 is started at a predetermined timing (step 7). If the sheet is not detected, the sheet feed failure is displayed at step 12, and the operation is stopped at step 13. When the fixing device is driven to perform the fixing operation in the manner described in the foregoing embodiment. The sheet P is passed through the fixing device 20 and is discharged onto the discharge tray 11, which is detected by the discharge sheet detecting sensor PH2 at step 8. In this embodiment, in response to the sheet detection signal, the gear train (FIG. 14) of the fixing device is shifted to the second state, and simultaneously, the electromagnetic solenoid 41 is energized to release the pressure contact between the heating member 21 and the pressing roller 22 to execute the film rewinding operation.

When the sheet is discharged at step 8, the next sheet feed is started (step 10 - step 4) if the next image formation is instructed. If not, the image forming operation is completed, and the apparatus is in the stand-by state (step 10 - step 11). If the discharge sheet detection is not made within a predetermined period of time, the sheet conveyance failure (sheet jam is displayed at step 14 and simultaneously, the apparatus is stopped at step 13. When the sheet is jammed, the jammed sheet is removed, and the circuit resetting button is depressed. Then, the door or doors of the apparatus are closed, a door switch is actuated, or the main power switch is actuated again, by which the film rewinding operation, that is, the initializing operation at step 2 of FIG. 20 is performed.

In the operations shown in FIG. 20, it is a possible alternative that after the sheet discharge detection at step 8, the fixing film 23 is continued to advance from the supply shaft 24 to the take-up shaft 27 without executing the film rewinding operation of step 9. In this case, the film shortage is detected by an unshown detecting means when the film 23 on the supply shaft 24 is used to an extent of near end, the signal representative of the shortage is supplied to the control circuit 42, in response to which the film rewinding operation is executed in the similar manner. During the rewinding period, the event is displayed, and the execution of the image forming operation is prohibited.

When the rewinding operation is completed, the prohibition of the image forming operation is released, and therefore, the image forming operation is enabled.

When plural image forming operation is instructed, and the film shortage signal is produced before the completion of the set number of image forming operations, the advancing movement of the fixing film is continued for the sheet existing in the fixing device 20 at this time to complete the fixing operation of the sheet. After the sheet is discharged, the subsequent image forming operation is interrupted, and the film rewinding operation is executed. After the completion of the rewinding operation, the remaining number of image forming operations is automatically performed.

In this embodiment, the film rewinding operation is executed when the main switch is turned on, and therefore, the fixing film is initialized upon the usage of the apparatus, and also, the film is initialized also when the main switch is turned of after the jam clearance.

In the embodiment shown in FIG. 14, as described hereinbefore, the fourth and fifth gears G4 and G5 constitute a stepped gear having a small diameter portion and a large diameter portion, and the tenth and eleventh gears G10 and G11 constitute a stepped gear having a large diameter and small diameter portions. Therefore, the number of reverse rotations of the rewinding shaft 24, the pressing roller 22 and the take-up shaft 27 are larger than those during the forward rotation, so that the film rewinding period is reduced.

In the driving system of FIG. 14, the film rewinding operation is performed at a speed which is 3.5 times the speed during the film taking up operation, so that the time loss due to the rewinding can be shortened. When the film is rewound each time the fixing operation is completed, the increase of the film movement speed during the film rewinding operation, the total length of the film can be reduced. By this, the film can be completely rewound prior to the next sheet reaching the image fixing device 20, so that image formation process speed is increased. By increasing the rewinding speed to 3.5 times, the process speed is increased from 4 cpm (same speed rewinding) up to 6 cpm when A4 size sheet is processed at the fixing process speed of 50 mm/sec.

Figure 21:
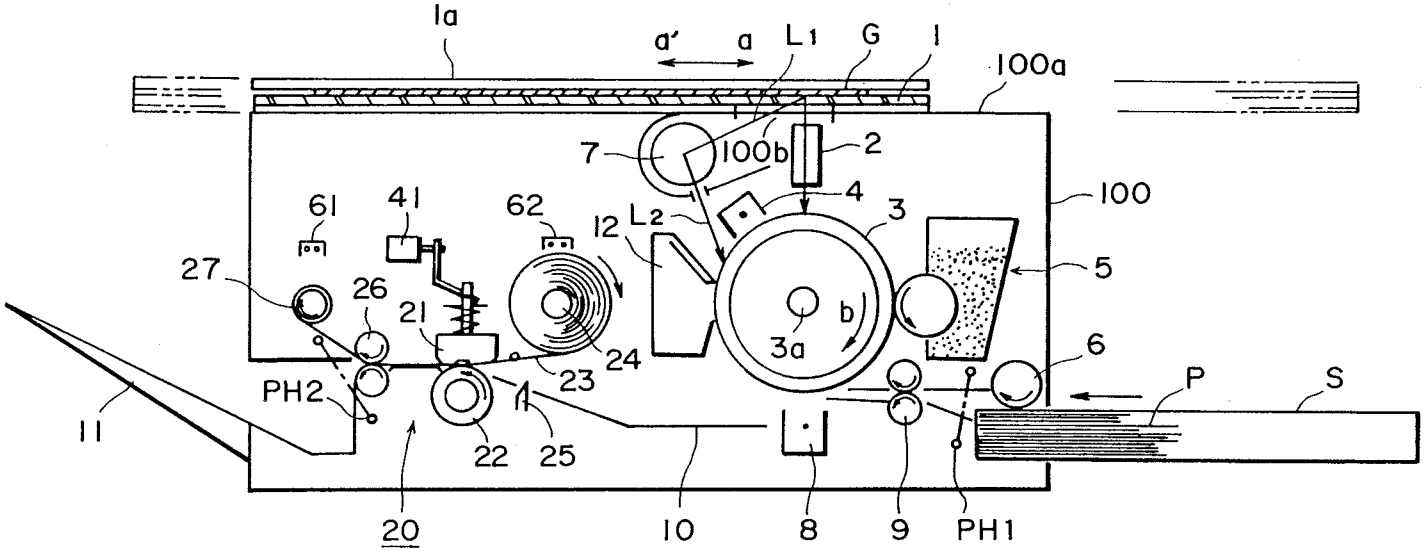
FIG. 21 is a sectional view of an image forming apparatus according to another embodiment of the present invention.

Referring to FIG. 21, a yet further embodiment will be described. The general structure thereof is similar to the embodiment of FIG. 11, although the fixing operation is different.

Figure 22A:
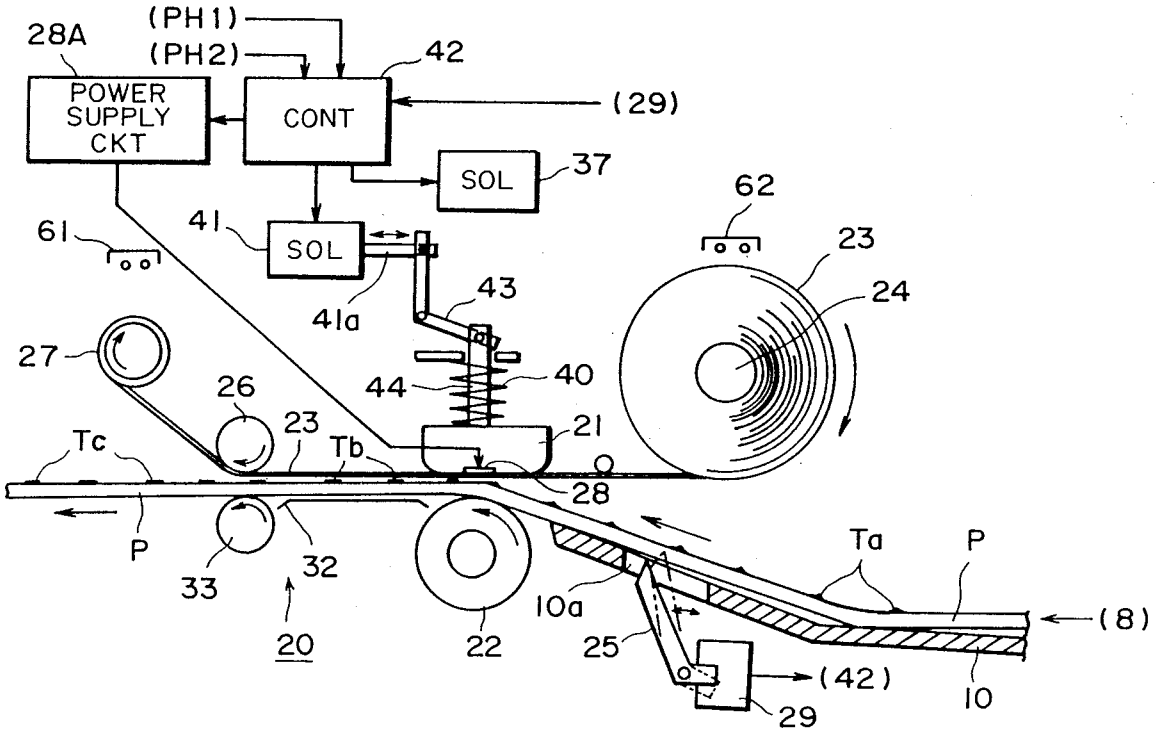
FIG. 22A is an enlarged view of the fixing device of the image forming apparatus of FIG. 21 during the fixing operation being performed.
Figure 22B:
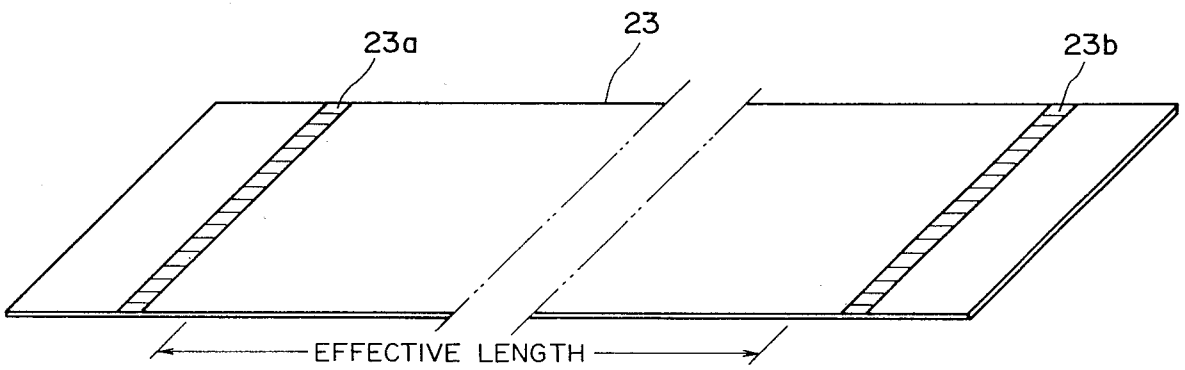
FIG. 22B is a perspective view illustrating a leading edge and a trailing edge of an image fixing film.

FIG. 22A and 22B are an enlarged sectional view of the fixing device and an enlarged view of the fixing film. As shown in FIG. 22B, the fixing film of this embodiment is provided with a mark 23*a* representative of the leading edge of the film adjacent to the leading edge of the film rolled on the supply shaft 27, and is provided with a mark 23*b* representative of the trailing edge of the film adjacent the trailing edge rolled on the take-up shaft 27.

Referring to FIGS. 21 and 22, there are first and second mark detectors 61 and 62 disposed adjacent to the take-up shaft 27 and the supply or rewinding shaft 24. The fixing film 23 is taken up on the take-up shaft 27 from the supply shaft 24 by the execution of the image fixing operation. When the trailing edge mark 23*b* is exposed, it is detected by the second mark detector 62, and a film rewinding start signal is produced in the control circuit. Then, the film is rewound from the take-up shaft 27 back to the supply or rewinding shaft 24. When the leading edge mark 23*a* is detected by the first mark detector 61, the rewinding termination signal is supplied to the control circuit.

Figure 23A:
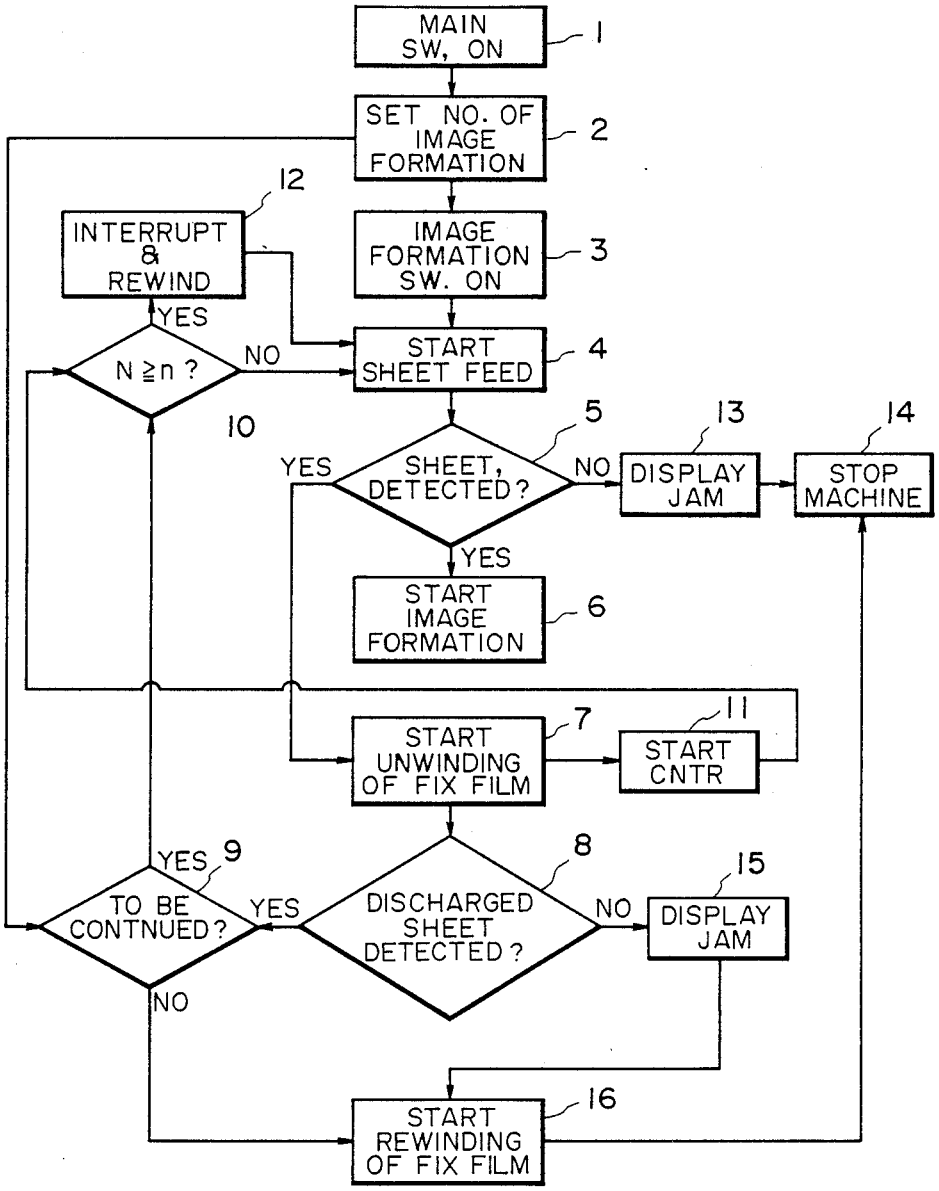
FIG. 23 is a flow chart illustrating operational control of the apparatus of FIG. 21.
FIG. 23B illustrates take-up and rewinding operation for the image fixing film during multi-copy producing operation.

FIG. 23A is a flow chart illustrating the operation of the apparatus of this embodiment. The main switch of the apparatus is turned on at step 1, and the desired number of image formations N is set at step 2. The size of the sheet P is set, and also the magnification, image density and other image forming condition or conditions are set. Then, the image formation start switch is depressed at step 3.

The gear train (FIG. 14) of the driving system of the fixing device 20 is normally maintained at the first state, and therefore, the first gear G1 is not rotated, by which the take-up shaft 27, the rewinding shaft 24 and the pressing roller 22 are not rotated.

Upon actuation of the image formation start switch (step S3), the sheet P is fed out of the cassette S by the feeding roller 6 at step 4, the fed sheet is detected by the sensor TH1 (yes, at step 5). The image forming operation on the photosensitive drum 3 is started at step 6.

Upon elapse of a predetermined timer period from the sheet detection by the sensor TH1, that is, when the sheet P fed from the cassette S is passed through the registration roller couple 9, the transfer station 8 and the guide 10, the leading edge thereof reaches the neighborhood of the nip between the heating member 21 and the pressing roller 22, the first gear G1 of the driving system (FIG. 14) is started to rotate in the direction X. By this, the fixing device 20 is brought into the film take-up mode wherein the fixing film 23 is advanced in the forward direction at the same speed as the sheet P at step 7.

(I) N at step 2 is 1, that is, the mono-copy mode is selected, the result of discrimination at step 9 subsequent to the discharge sheet detection at step 8 is "no". In this case, when the sheet P is discharged onto the discharge tray 11, the film rewinding operation is started at step 16 until the fixing film is reset to the initial state, and then the apparatus is now in the stand-by state at step 14.

(II) $N \leqq n$ (=9)

When the number set at the step 2 N is equal to or smaller than n, that is, when the multi-copy mode is selected, but the set number is 9 or smaller, the number N of the operation cycles constituted by the steps 4–10 are repeated sequentially. When the Nth, that is, the final sheet is discharged, the operation is performed through step 8 (yes), step 9 (no), step 16 and step 14), so that the fixing film 23 is rewound to the initial state, and then, the apparatus is stopped and kept in the stand-by state.

The step 11 is for counting the number of film taking up operations at step 7 to control the discrimination circuit used at step 10.

(III) N>n (=9)

When the number N set at step 2 is larger than n, that is, when the multi-copy mode is selected, and the number of image forming operation is larger than 9, the series of operations at step 12 constituted by the interruption of the image forming operation, the fixing film rewinding operation the fixing film resetting operation is performed each n time $n_{th}$ image formation cycle (steps 4–steps 10) is completed. After the completion of the resetting, the steps 4–10 are repeated, so that N sheets are discharged finally.

When the Nth sheet is discharged, the series of operations constituted by the step 8 (yes), the step 9 (no), the step 16 and the step 14, so that the fixing film 23 is rewound and initialized, and the apparatus is stopped in the stand-by state, similarly to the case of (I) and (II).

Figure 23B:
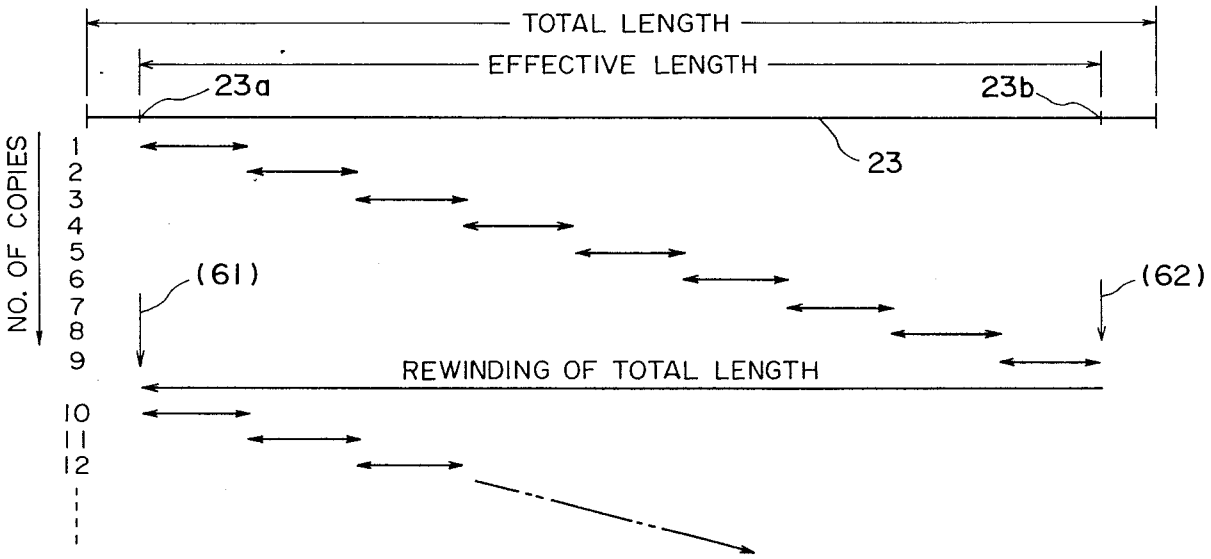

FIG. 23B shows the film taking-up and rewinding control for the fixing film 23 during the multi-copy mode operation. The detections of the completion of the fixing film take-up and the completion of the fixing film rewinding, are performed using the leading and trailing edge marks 23*a* and 23*b* of the fixing film 23 (FIG. 22B) and using the first and second detectors 61 and 62 (FIGS. 21 and 22).

In the film rewinding operation at the step 12 and the step 16, the electromagnetic solenoid 41 functioning as the pressure releasing means is energized, and the electromagnetic solenoid 37 in the driving system is energized. In the recording medium detection in the step 5, if the sheet is not detected at step 5 (no) by the sensor TH1 even after the elapse of the predetermined timer period from the start of the sheet feed, the sheet feed failure is displayed on the console panel at step 13, and simultaneously, the operation of the apparatus is stopped at step 14.

In the discharge sheet detection at step 8, if the discharge sheet is not detected at step 8 (no), after a predetermined period elapses from the detection at step 5 or from the detection of the sheet leading or trailing edge by the sensor 25 or 29, the failure of sheet conveyance is discriminated, and the event is displayed on the console panel at step 15, and simultaneously, the fixing film rewinding operation at step 16 is executed, and after the completion thereof, the operation of the image forming operation is stopped at step 14.

As described, when the apparatus is stopped by the failure of the sheet feed or sheet conveyance, the cause or causes of the failure is cleared, and the circuit setting button is depressed, then the image formation start switch is depressed again to resume the image forming operation.

In this embodiment, the fixing film rewinding operation is controlled on the basis of the detection of the leading or trailing portions of the fixing film, and the interval can be reduced, and in addition, the number of the recording sheets usable with one image fixing film can be increased to reduce the frequency of film exchange.

Figure 24:
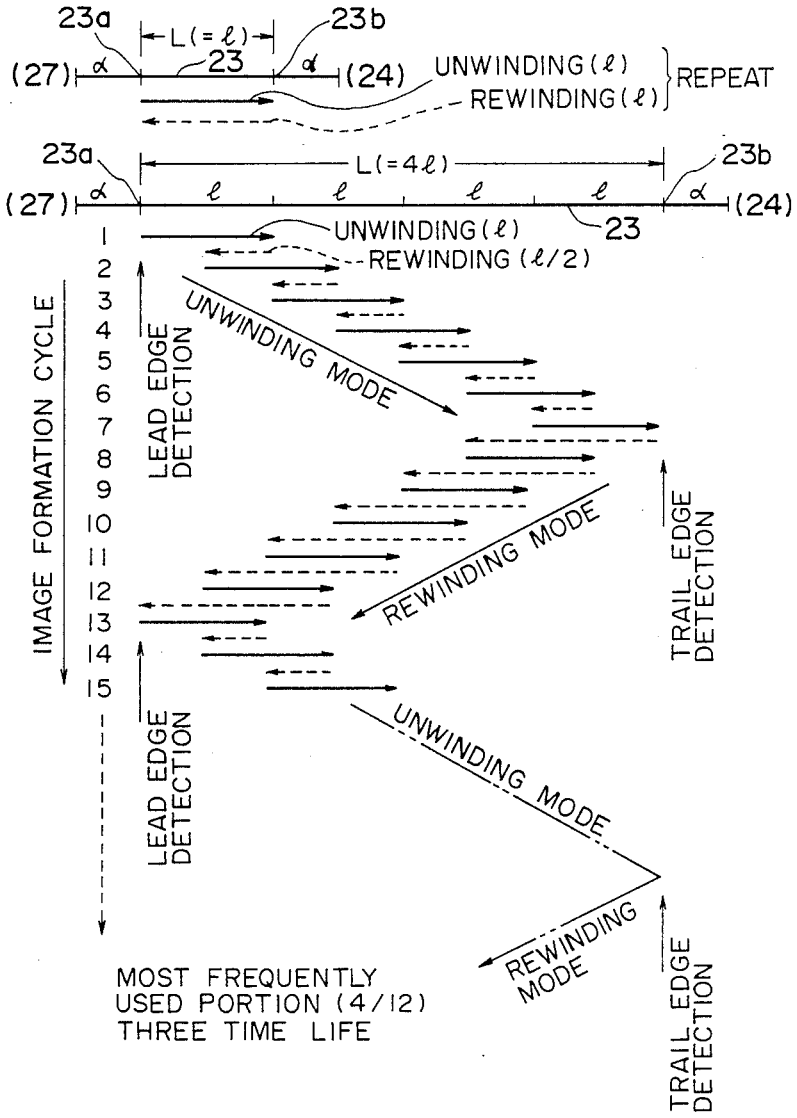
FIGS. 24 and 25 illustrate drive of the image fixing film according to another embodiment.
Figure 25:
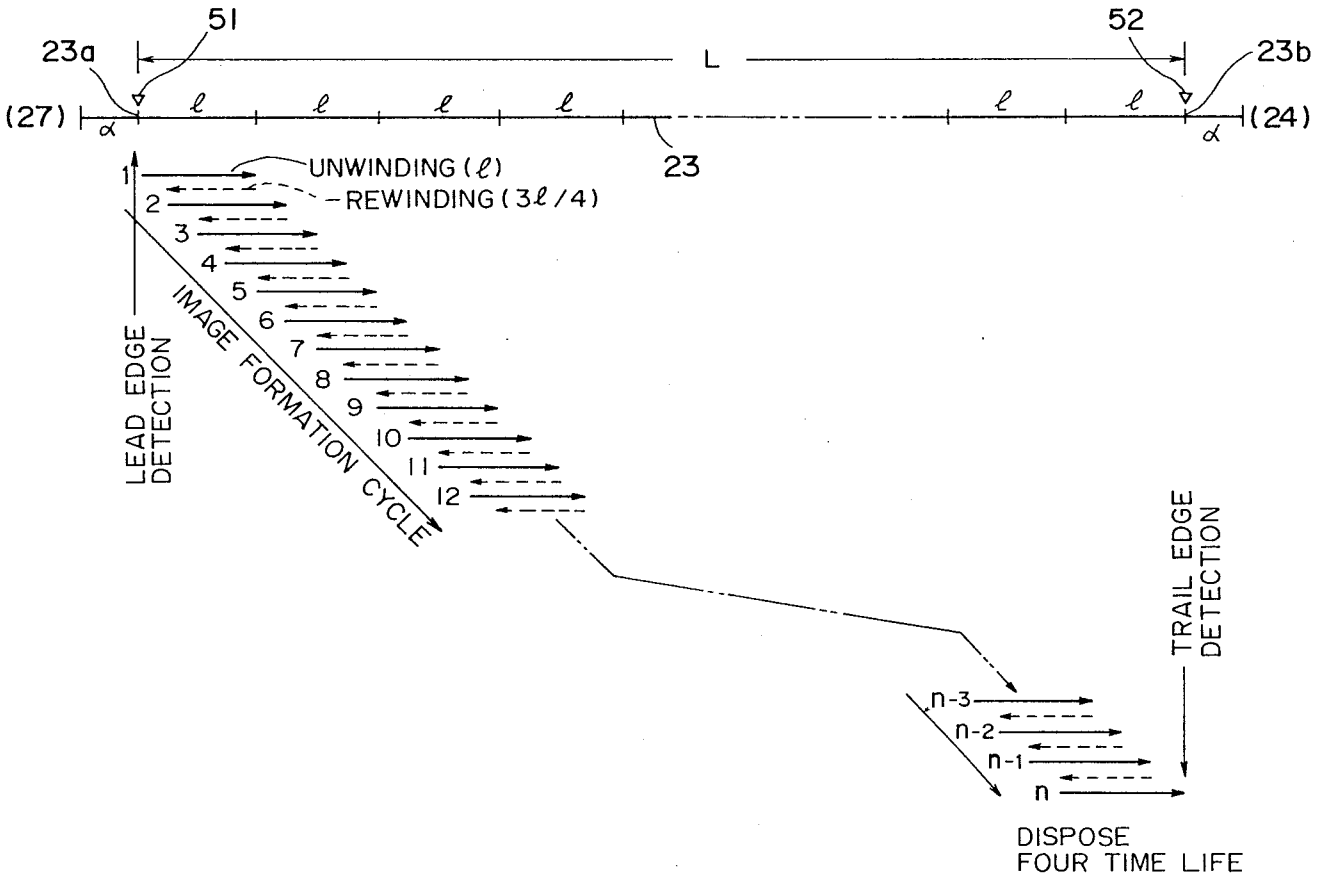

Referring to FIGS. 24 and 25, another operations with the structures of FIGS. 21 and 22 will be described. In this embodiment, the film rewinding operation is performed at least each time of the period which is after the trailing edge of the recording medium departs from the fixing film after the execution of the image fixing operation and before the leading edge of the recording medium enters the fixing means. Further, the amount of rewinding is different from the amount of the film taking-up, so that the fixing film set between the supply means and the take-up means is gradually renewed by the amount corresponding to the difference between the taking-up amount and the rewinding amount. By this, a portion of the fixing film can be used repeatedly sequentially, thus the durability of the fixing film can be increased (the durable number is several times), whereby the frequency of the fixing film exchange operations can be reduced.

Referring to FIG. 24, the fixing film 23 is gradually re-newed by the difference between the taking-up or supply length l and the rewinding length 1/2, while it is supplied from the supply shaft 24 and taken up by the take-up shaft 27 (taking-up mode). When almost all of the fixing film is taken up from the supply shaft 24 onto the take-up shaft, and the trailing edge of the film is detected by the second detector 62, the film rewinding length is changed to be 31/2 with the film taking up length remaining unchanged, so that the fixing film is now gradually rewound from the take-up real 27 to the supply shaft 24 gradually by the amount corresponding to the difference between the taking up length l and the rewinding length 31/2, while the fixing film being intermittently used for the image forming operation for the sheets p rewinding mode. In this manner, the taking-up mode and the rewinding mode are repeated alternately each time the detection of the film leading and trailing edges of the fixing film by the first and second detectors 61 and 62.

In this embodiment, the effective fixing length L of the fixing film 23 is 41. When 12 sheets are processed for the image formation, the central portion of the effective length L of the fixing film, that is, most frequently used fixes 4 sheets. As compared with the case where the fixing film has an effective length l corresponding to one recording medium, and the entirety of the length l is repeated used for the image fixing, the durable number becomes three times by increasing the effective length L to 4 times (41).

After the final sheet discharge is detected in the multi-copy mode, or after the discharge sheet is detected in the mono-copy mode, the image forming operation is completed, and the image forming apparatus is in the stand-by state.

FIG. 25 illustrates another example of the drive of the fixing film. In this example, a long fixing film is gradually renewed in the taking-up mode by the relation of the rewinding length smaller than the taking-up or supply length. The rewinding length can be selected correspondingly to the durability of the fixing film, so that the thin fixing film can be used while gradually rewinding. By reducing the film thickness, the consumption of the thermal energy can be reduced, so that the device becomes more economical.

More particularly, the fixing film 23 is repeatedly usable four times, and when the film is taken up by the length l for the fixing process of one sheet, the subsequent rewinding length is 31/4. With the repeated use, the trailing edge of the film is detected by the sensor 52, the fixing film is exchanged with a new one.

The detection of the fixing film 23 leading edge and trailing edge portions can be performed with the type of a photoelectric system, magnetic, mechanical or electric system.

Figure 26:
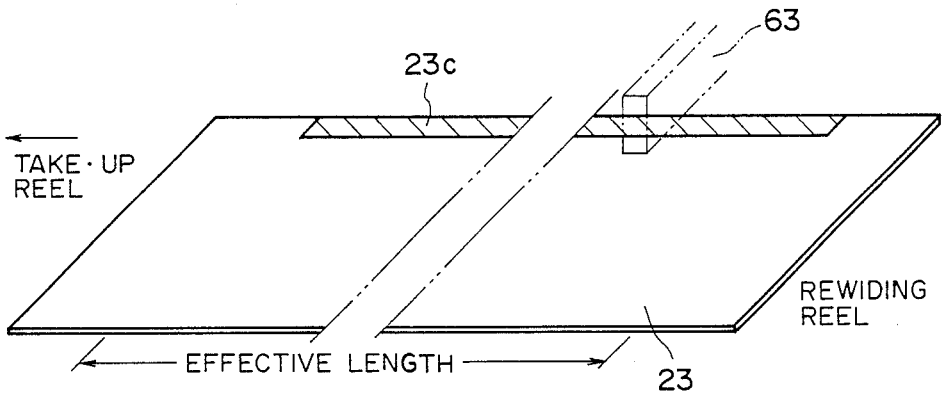
FIG. 26 is a perspective view of an image fixing film having a magnetic pattern stripe for position detection provided along a lateral tend thereof.

FIG. 26 shows another example of the fixing film which can be detected. Adjacent a latent end of the fixing film 23, positional information is printed as a magnetic pattern 23c, extending along the length of the fixing film, continuously or intermittently. The positional information relating to the information in the direction of the length thereof. The positional information is detected by a magnetic encoder 63. On the basis of the positional information of the fixing film, the supply and the rewinding of the fixing film can be controlled similarly to the foregoing embodiments.

Figure 27:
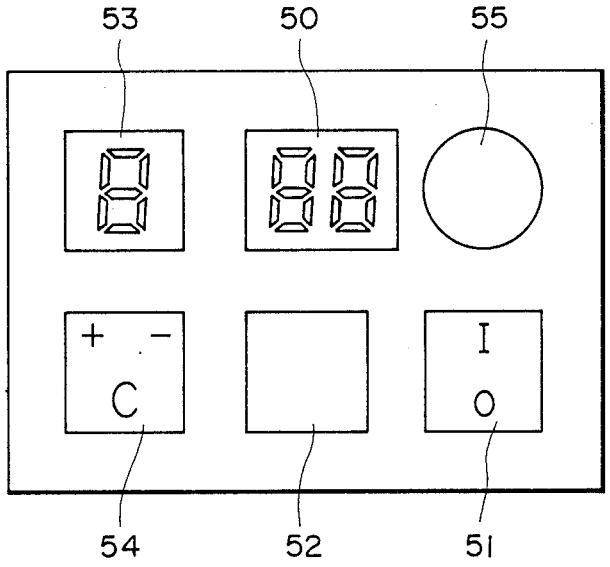
FIG. 27 is a plan view of an operation panel.

This detecting system is capable of detecting not only the leading and trailing edge information of the fixing film but also the positional information therebetween, and therefore, the remaining length of the fixing film, that is, the copyable number can be displayed on the display 50 of the operation panel of FIG. 27. In addition, by always detecting the positional information of the fixing film, it is possible to detect the malfunction of the fixing film such as production of crease or the tearing of the film.

The operation panel of FIG. 27 includes a main power switch 51, an image formation start switch 52, a set number display 53, a number setting switch 54 and a power display lamp 55.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:
heating means;
a non-endless film movable together with a toner image supporting medium supporting a toner image, wherein the toner image on the supporting medium is heated by said heating means through said film;
rewinding means for rewinding said film in a direction opposite to a movement direction of said toner image supporting medium;
pressing means for press-contacting said film to said heating means and to said image supporting medium;
wherein said rewinding means rewinds said film while said pressing means does not perform it pressing operation.

2. An apparatus according to claim 1, wherein said pressing means resumes its pressing operation automatically after completion of the rewinding operation.

3. An apparatus according to claim 1, wherein said rewinding means includes a spiral spring, and wherein said spiral spring is charged during an unwinding movement of said film, and said film is rewound by the charged spiral spring.

4. An apparatus according to claim 1, wherein said apparatus is used with a copying apparatus wherein a copy of an original image is produced by scanning an original while a relative movement is imparted between an image scanning means and the original, and wherein the pressing operation of said pressing means is stopped using the relative movement between the original and the scanning means.

5. An apparatus according to claim 1, wherein said heating means is fixed in use, and wherein no air gap exists between said heating means and the toner image.

6. An apparatus according to claim 5, wherein said heating means includes a heat generating layer extending in a direction crossing a direction of movement of said film.

7. An apparatus according to claim 6, wherein said film is separated from the toner image at a position downstream of said heat generating layer with respect to a movement direction of the toner image supporting medium.

8. An image fixing apparatus, comprising:
heating means;
a non-endless film movable together with a toner image supporting medium supporting a toner image, wherein the toner image on the supporting medium is heated by said heating means through said film;
rewinding means for rewinding said film in a direction opposite to a movement direction of the toner image supporting medium; and
wherein during a rewinding operation by said rewinding means, said heating means is not energized.

9. An apparatus according to claim 8, further comprising means for detecting completion of film rewinding, and in response to an output of said detecting means, said heating means is permitted to be energized.

10. An apparatus according to claim 8, wherein said fixing means is used with an image forming apparatus, wherein during a rewinding operation by said rewinding means, an image forming operation of said image forming apparatus is disabled.

11. An apparatus according to claim 10, further comprising means for detecting completion of film rewinding, and in response to an output of said detecting means, the disabling of the image forming operation is removed.

12. An apparatus according to claim 8, wherein said heating means is fixed in use, and wherein no air gap exists between said heating means and the toner image.

13. An apparatus according to claim 12, wherein said heating means includes a heat generating layer extending in a direction crossing a direction of movement of said film.

14. An apparatus according to claim 13, wherein said film is separated from the toner image at a position downstream of said heat generating layer with respect to a movement direction of the toner image supporting medium.

15. An image fixing apparatus, comprising:
heating means;
a non-endless film movable together with a toner image supporting medium supporting a toner image, wherein the toner image on said supporting medium is heated by said heating means through said film;
rewinding means for rewinding said film in a direction opposite to a movement direction of the toner image supporting medium;
wherein said rewinding means rewinds said film each time a predetermined number of said toner image supporting mediums are fixed.

16. An apparatus according to claim 15, wherein said predetermined number is one.

17. An apparatus according to claim 16, wherein said rewinding means rewinds said film during a period from departure of said supporting medium from said film and arrival of a next supporting medium at said film.

18. An apparatus according to claim 16, wherein said film has as length measured in a movement direction of the supporting medium is slightly longer than a maximum usable size of said supporting medium.

19. An apparatus according to claim 15, wherein said heating means is fixed in use, and wherein no air gap exists between said heating means and the toner image.

20. An apparatus according to claim 19, wherein said heating means includes a heat generating layer extending in a direction crossing a direction of movement of said film.

21. An apparatus according to claim 20, wherein said film is separated from the toner image at a position downstream of said heat generating layer with respect to a movement direction of the toner image supporting medium.

22. An image forming apparatus, comprising:

means for forming an unfixed toner image on a image supporting medium;

fixing means for fixing the unfixed toner image on said supporting medium;

said fixing means comprising:

heating means;

a non-endless film movable together with a toner image supporting medium supporting a toner image wherein the toner image on said supporting medium is heated by said heating means through said film;

rewinding means for rewinding said film in a direction opposite to a movement direction of the toner image supporting medium;

wherein said rewinding means rewinds said film upon a power switch of said image forming apparatus is actuated.

23. An apparatus according to claim 22, wherein said heating means is fixed in use, and wherein no air gap exists between said heating means and the toner image.

24. An apparatus according to claim 23, wherein said heating means includes a heat generating layer extending in a direction crossing a direction of movement of said film.

25. An apparatus according to claim 24, wherein said film is separated from the toner image at a position downstream of said heat generating layer with respect to a movement direction of the toner image supporting medium.

26. An image fixing apparatus, comprising:

heating means;

a non-endless film movable together with a toner image supporting medium supporting a toner image, wherein the toner image on said toner image supporting medium is heated by said heating means through said film;

rewinding means for rewinding said film in a direction opposite to a movement direction of said supporting medium;

wherein said rewinding means rewinds said film at a speed higher than a speed of said film during its image fixing operation.

27. An apparatus according to claim 26, wherein said rewinding means rewinds said film each time one supporting medium is fixed.

28. An apparatus according to claim 26, wherein said heating means is fixed in use, and wherein no air gap exists between said heating means and the toner image.

29. An apparatus according to claim 28, wherein said heating means includes a heat generating layer extending in a direction crossing a direction of movement of said film.

30. An apparatus according to claim 29, wherein said film is separated from the toner image at a position downstream of said heat generating layer with respect to a movement direction of the toner image supporting medium.

31. An image forming apparatus, comprising:

means for forming an unfixed toner image on a toner image supporting medium;

fixing means for fixing the unfixed toner image on said supporting medium, said fixing means comprising:

heating means;

a non-endless film movable together with the supporting medium, wherein the unfixed toner image on said supporting medium is heated by said heating means through said film;

rewinding means for rewinding said film in a direction opposite to a movement direction of said supporting medium;

wherein said image forming apparatus is capable of an intermittent mode operation wherein one image formation is performed intermittently and a continuous mode wherein plural image forming operations are performed continuously;

wherein said rewinding means rewinds said film each time a predetermined of the supporting mediums are fixed, and wherein the predetermined number is larger in said continuous mode than in the intermittent mode.

32. An apparatus according to claim 31, wherein the predetermined number in the intermittent mode is one, and the predetermined number in the continuous mode is nine.

33. An apparatus according to claim 31, wherein said heating means is fixed in use, and wherein no air gap exists between said heating means and the toner image.

34. An apparatus according to claim 33, wherein said heating means includes a heat generating layer extending in a direction crossing a direction of movement of said film.

35. An apparatus according to claim 34, wherein said film is separated from the toner image at a position downstream of said heat generating layer with respect to a movement direction of the toner image supporting medium.

36. An apparatus according to claim 1, 8, 15 or 26, wherein said toner image is an unfixed toner image.

37. An apparatus according to claim 1, 8, 15, 22, 26 or 31, wherein said film is contacted to the toner image during its image fixing operation.

38. An apparatus according to claim 8, 15, 22, 26 or 31, further comprising pressing means for pressing said film to said heating means and to said supporting medium.

39. An apparatus according to claim 38, wherein said rewinding means rewinds said film while said pressing means does not perform its pressing function.

40. An apparatus according to claim 1, 8, 15, 22, 26 or 31, wherein said film is provided with a mark representative of completion of rewinding, and in response to detection of the mark, said rewinding means terminates its rewinding operation.

41. An apparatus according to claim 1, wherein said pressing means includes a pressing rotatable member contactable to the supporting medium, and said pressing rotatable member is moved away from said film to stop its pressing operation.

42. An apparatus according to claim 1, 8, 15, 22, 26 or 31, further comprising display means for displaying that said film is being rewound.

* * * * *

UNITED STATES PATENT AND TRADEMARK OFFICE

CERTIFICATE OF CORRECTION

PATENT NO. : 4,954,845

DATED : September 4, 1990

INVENTOR(S) : Yano et al.

It is certified that error appears in the above-identified patent and that said Letters Patent is hereby corrected as shown below:

COLUMN 27
Line 46, change "it" to --its--.

COLUMN 3
Line 10, change "changes" to --changes in--; and
Line 27, change "FIG. 23" to --FIG. 23A--.

COLUMN 6
Line 67, change "allow" to --arrow--.

COLUMN 9
Line 30, change "elongated slots 70a" to --elongated slot 70a--.

COLUMN 12
Line 36, delete "by".

COLUMN 13
Line 15, delete "fourth bear G4," to --fourth gear G4,--.

COLUMN 16
Line 29, change "take-up s [illegible] 27--.

Signed and Sealed this

Twenty-eighth Day of April, 1992

*Attest:*

HARRY F. MANBECK, JR.

*Attesting Officer*

*Commissioner of Patents and Trademarks*